US012091765B2

(12) United States Patent
Mosser et al.

(10) Patent No.: US 12,091,765 B2
(45) Date of Patent: Sep. 17, 2024

(54) APPARATUSES AND SYSTEMS FOR VERTICAL ELECTROLYSIS CELLS

(71) Applicant: ALCOA USA CORP., Pittsburgh, PA (US)

(72) Inventors: Benjamin D. Mosser, Pittsburgh, PA (US); Lance M. Sworts, New Kensington, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 0 days.

(21) Appl. No.: 17/556,757

(22) Filed: Dec. 20, 2021

(65) Prior Publication Data

US 2022/0112617 A1 Apr. 14, 2022

Related U.S. Application Data

(62) Division of application No. 15/474,934, filed on Mar. 30, 2017, now Pat. No. 11,203,814.

(60) Provisional application No. 62/315,414, filed on Mar. 30, 2016.

(51) Int. Cl.

| | |
|---|---|
| ***C25C 3/00*** | (2006.01) |
| ***C25C 3/08*** | (2006.01) |
| ***C25C 3/12*** | (2006.01) |
| ***C25C 7/00*** | (2006.01) |

(52) U.S. Cl.
CPC ..... *C25C 3/08* (2013.01); *C25C 3/12* (2013.01); *C25C 7/005* (2013.01)

(58) Field of Classification Search
CPC ..... C25C 3/08; C25C 3/12; C25C 7/005; C25B 9/63; C25B 9/65; C25B 11/00
See application file for complete search history.

(56) References Cited

U.S. PATENT DOCUMENTS

| | | | | |
|---|---|---|---|---|
| 3,859,196 | A * | 1/1975 | Ruthel | C25B 9/65 204/266 |
| 4,405,433 | A * | 9/1983 | Payne | C25C 3/08 204/288.6 |
| 5,286,359 | A * | 2/1994 | Richards | C25C 3/08 204/291 |
| 2004/0016639 | A1 * | 1/2004 | Tabereaux, Jr. | C25C 3/08 204/286.1 |

OTHER PUBLICATIONS

WO2008132590; Nguyen, Thinh; Nov. 2008.*

* cited by examiner

*Primary Examiner* — Zulmariam Mendez
(74) *Attorney, Agent, or Firm* — Greenberg Traurig, LLP

(57) ABSTRACT

In one embodiment, the disclosed subject matter relates to an electrolytic cell that has: a cell reservoir; a cathode support retained on a bottom of the cell reservoir, wherein the cathode support contacts at least one of: a metal pad and a molten electrolyte bath within the cell reservoir, wherein the cathode support includes: a body having a support bottom, which is configured to be in communication with the bottom of the electrolysis cell; and a support top, opposite the support bottom, having a cathode attachment area configured to retain a at least one cathode plate therein.

20 Claims, 20 Drawing Sheets

APPARATUSES AND SYSTEMS FOR VERTICAL ELECTROLYSIS CELLS

CROSS REFERENCE TO RELATED APPLICATIONS

This application is a divisional application of Ser. No. 15/474,934, now U.S. Pat. No. 11,203,814, which claims priority to U.S. provisional patent application Ser. No. 62/315,414, filed Mar. 30, 2016, each of which is hereby incorporated by reference in its entirety.

FIELD OF THE INVENTION

Broadly, the present disclosure relates to vertical cell electrode assemblies, in which both anodes and cathodes are configured in a vertical, alternating parallel configuration. More specifically, the present disclosure relates to vertical cell electrode assemblies, including the cathode support assembly/apparatus which is configured to retain cathode(s) in the cell bottom in a substantially vertical configuration.

BACKGROUND

Commercial Hall cells have a two-dimensional configuration, in which the bottom of the cell is a carbon block (e.g. graphite) and the anodes are raised/lowered from above, such that aluminum is produced along a single plane (e.g. as defined by the anode-cathode distance, or the gap between the lowermost portion of the anodes and the upper most portion of the cathode).

SUMMARY

Broadly, the present disclosure relates to vertical cell electrode assemblies, in which both anodes and cathodes are configured in a vertical, alternating parallel configuration. More specifically, the present disclosure relates to vertical cell electrode assemblies, including the cathode support assembly/apparatus which is configured to retain the cathode(s) in the cell bottom in a substantially vertical configuration. Various ones of the inventive aspects noted hereinabove may be combined to yield electrolysis cells, cathode supports, and methods of making aluminum in an electrolysis cell having vertical cell configurations. These and other aspects, advantages, and novel features of the invention are set forth in part in the description that follows and will become apparent to those skilled in the art upon examination of the following description and figures, or may be learned by practicing the invention.

The disclosed subject matter relates to an electrolytic cell that has: a cell reservoir; a cathode support retained on a bottom of the cell reservoir, wherein the cathode support contacts at least one of: a metal pad and a molten electrolyte bath within the cell reservoir, wherein the cathode support includes: a body having a support bottom, which is configured to be in communication with the bottom of the electrolysis cell; and a support top, opposite the support bottom, having a cathode attachment area configured to retain a at least one cathode plates therein.

In another embodiment, the cathode attachment area of the cathode support comprises: surface grooves on an upper surface of the cathode support, where the grooves are configured to a sufficient depth to retain one of the at least one cathode plates.

In another embodiment, the cathode attachment area of the cathode support comprises: first plurality of beams comprising one or more grooves formed in a surface of the first plurality of beams, wherein the one or more grooves are configured to retain the at least one cathode plates; and a second plurality of beams connecting the first plurality of beams.

In another embodiment, the at least one cathode plates in the cathode attachment area are configured such that edges of a first cathode plate touch edges of the cathodes plates which oppose the first cathode plate on either side.

In another embodiment, the cathode support comprises a plurality of pins, wherein each pin has a pin bottom and a pin top.

In another embodiment, each pin bottom is retained by a corresponding opening in the cathode support.

In another embodiment, the plurality of pins are configured in a spaced relation to support one of the at least one cathode plates in a vertical configuration.

In another embodiment, the plurality of pins includes a first set of pins and a second set of pins.

In another embodiment, the pin bottoms of the first set of pins are arranged in a linear formation on the cathode support and the pin bottoms of the second set of pins are arranged in a linear formation on the cathode support.

In another embodiment, the linear formation of the pin bottoms of the first set of pins is parallel to the linear formation of the pin bottoms of the second set of pins.

In another embodiment, the pin tops are configured to support a non-planar cathode plate in a vertical configuration.

In another embodiment, the first set of pins and the second set of pins each comprises a first pin having a pin top with a first shape and a second pin having a pin top with a second shape.

In another embodiment, the first shape is different than the second shape.

In another embodiment, the pin top of the first pin has a first diameter and the pin top of the second pin has a second diameter.

In another embodiment, the first diameter is different than the second diameter.

In another embodiment, the first pin and the second pin have pin bottoms of a first diameter and wherein the first pin and the second pin have pin tops of a second diameter.

In another embodiment, the first diameter is different than the second diameter.

In another embodiment, the pin tops have a laterally non-symmetrical shape.

In another embodiment, the pins are comprised of titanium diboride.

In another embodiment, the pin top of at least one of the plurality of pins has a varying radius.

In another embodiment, the at least one pin having the varying radius rotates until a desired clearance between the at least one pin and the cathode plate is achieved.

In another embodiment, the pin bottom is embedded into the cathode support and the pin top comprises two prongs, wherein one of the at least one cathode plate is positioned between the two prongs.

In another embodiment, a cathode plate is comprised of multiple cathode plates.

In another embodiment, at least two of the cathode plates mechanically interlock together.

In another embodiment, each cathode plate comprises side edges configured to mechanically interlock with adjacent cathode plates.

In another embodiment, side edges of the first cathode plate are concave and configured to interlock with the convex side edges of adjacent cathode plates.

In another embodiment, the edges of the cathode plates have holes to accommodate pins that mechanically interlock the cathode plates together.

In another embodiment, a cathode plate, supported on opposing edges by interlocking cathode plates, comprises a crack.

In another embodiment, the cathode plate is supported by adjacent cathode plates and not mounted to the cathode support.

In another embodiment, a flow path is formed between the cathode support and the cathode plate.

In another embodiment, a method for producing aluminum metal by the electrochemical reduction of alumina, includes: (a) passing current between an anode and a cathode through an electrolytic bath of an electrolytic cell, the cell comprising: (i) a cell reservoir, (ii) a cathode support retained on a bottom of the cell reservoir, wherein the cathode support contacts at least one of: a metal pad and a molten electrolyte bath within the cell reservoir, wherein the cathode support includes: a body having a support bottom, which is configured to be in communication with the bottom of the electrolysis cell; and a support top, opposite the support bottom, having a cathode attachment area configured to retain a at least one cathode plates therein; and (b) feeding a feed material into the electrolytic cell.

In another embodiment, the feed material is electrolytically reduced into a metal product.

In another embodiment, the metal product is drained from the cathodes to the cell bottom to form a metal pad.

The disclosed subject matter relates to an electrolytic cell, comprising: a cell reservoir; a cathode support retained on a bottom of the cell reservoir; a cathode plate retained on the cathode support, wherein the cathode plate has an edge that is configured to mechanically interlock with adjacent cathode plates.

In another embodiment, the cathode plate has a top edge, an opposing bottom edge, a first side edge and a second side edge, wherein the first side edge is configured to mechanically interlock with a side edge of a first adjacent cathode plate and wherein the second side edge is configured to mechanically interlock with a side edge of a second adjacent cathode plate.

In another embodiment, the first side edge and the second side edge are beveled edges that mechanically interlock with a corresponding beveled side edge of the first adjacent cathode plate and a corresponding beveled side edge of the second adjacent cathode plate.

In another embodiment, the cathode plate is supported above the cathode support by the first adjacent cathode plate and the second adjacent cathode plate.

In another embodiment, the first side edge and the second side edge of the cathode plate is convex shaped and the corresponding side edge of the first adjacent cathode plate and the corresponding beveled side edge of the second adjacent cathode plate are concave shaped.

In another embodiment, the cathode plate is formed from an array of cathode tiles, wherein each cathode tile is interlocked to adjacent cathode tiles.

In another embodiment, each cathode tile is hexagonal shaped.

Figure 1:
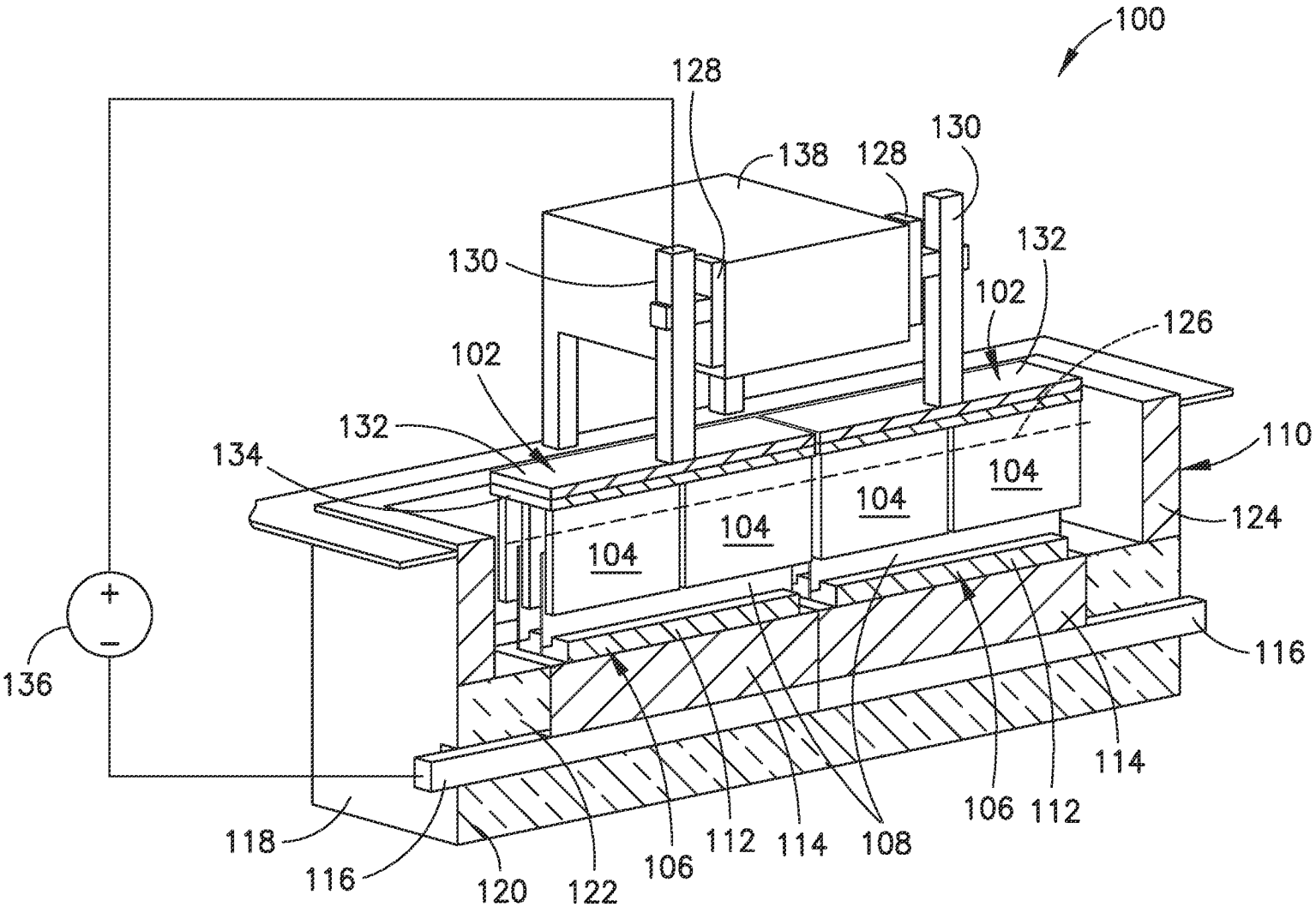
FIG. 1 is a partially schematic cross-sectional view of an electrolytic cell in accordance with an embodiment of the present disclosure.

While various embodiments of the present invention have been described in detail, it is apparent that modifications and adaptations of those embodiments will occur to those skilled in the art. However, it is to be expressly understood that such modifications and adaptations are within the spirit and scope of the present invention.

DETAILED DESCRIPTION

As used herein, "electrolysis" means any process that brings about a chemical reaction by passing electric current through a material. In some embodiments, electrolysis occurs where a species of metal is reduced in an electrolysis cell to produce a metal product. Some non-limiting examples of electrolysis include primary metal production. Some non-limiting examples of primary metals include: aluminum, nickel, etc.

As used herein, "electrolysis cell" means a device for producing electrolysis. In some embodiments, the electrolysis cell includes a smelting pot, or a line of smelters (e.g. multiple pots). In one non-limiting example, the electrolysis cell is fitted with electrodes, which act as a conductor, through which a current enters or leaves a nonmetallic medium (e.g. electrolyte bath).

As used herein, "electrode" means a positively charged electrode (e.g. anode) or a negatively charged electrode (e.g. cathode).

As used herein, "anode" means the positive electrode (or terminal) by which current enters an electrolytic cell. In some embodiments, the anodes are constructed of electrically conductive materials. In some embodiments, the anodes comprise carbon anodes. In some embodiments, the anodes comprise inert anodes. As used herein, "anode assembly" includes one or more anode(s) connected with, a support. In some embodiments, the anode assembly includes: the anodes, the support (e.g. refractory block and other bath resistant materials), and the electrical bus work.

As used herein, "support" means a member that maintains another object(s) in place. In one embodiment, the support is constructed of a material that is resistant to attack from the corrosive bath.

As used herein, "cathode" means the negative electrode or terminal by which current leaves an electrolytic cell. In some embodiments, the cathodes are constructed of an electrically conductive material. Some non-limiting examples of the cathode material include: carbon, cermet, ceramic material(s), metallic material(s), and combinations thereof. In one embodiment, the cathode is constructed of a transition metal boride compound, for example $TiB_2$. In some embodiments, the cathode is electrically connected through the bottom of the cell (e.g. current collector bar and electrical buswork). In some embodiments, the cathode comprises a body with two opposing generally planar faces and a perimetrical edge (e.g. flat or rounded) surrounding the two planar faces. In some embodiments, the cathodes comprise plates.

As used herein, "cathode assembly" refers to the cathode (e.g. cathode block), the current collector bar, the electrical bus work, and combinations thereof.

As used herein "current collector bar" refers to a bar that collects current from the cell. In one non-limiting example, the current collector bar collects current from the cathode and transfers the current to the electrical buswork to remove the current from the system.

As used herein, "electrolyte bath" refers to a liquefied bath having at least one species of metal to be reduced (e.g. via an electrolysis process). A non-limiting example of the electrolytic bath composition includes: NaF, $AlF_3$, $CaF_2$, $MgF_2$, LiF, KF, and combinations thereof—with dissolved alumina.

As used herein, "molten" means in a flowable form (e.g. liquid) through the application of heat. As a non-limiting example, the electrolytic bath is in molten form (e.g. at least about 750° C.). As another non-limiting example, the electrolytic bath is in molten form (e.g. not greater than about 1000° C.). As another example, the metal product (e.g. aluminum) that forms at the bottom of the cell (e.g. sometimes called a "metal pad") is in molten form.

As used herein, "metal product" means the product which is produced by electrolysis. In one embodiment, the metal product forms at the bottom of an electrolysis cell as a metal pad. Some non-limiting examples of metal products include: rare earth metals and non-ferrous metals (e.g. aluminum, nickel, magnesium, copper, and zinc). In some embodiments, the metal product includes impurities (e.g. Fe, Si, Ni, Mn, and others in Al metal product).

As used herein, "sidewall" means the wall of an electrolysis cell. In some embodiments, the sidewall runs parametrically around the cell bottom and extends upward from the cell bottom to defines the body of the electrolysis cell and define the volume where the electrolyte bath is held. In some embodiments, the sidewall includes: an outer shell, a thermal insulation package, and an inner wall. In some embodiments, the inner wall and cell bottom are configured to contact and retain the molten electrolyte bath and the metal product (e.g. metal pad).

As used herein, "outer shell" means an outer-most protecting cover portion of the sidewall. In one embodiment, the outer shell is the protecting cover of the inner wall of the electrolysis cell. As non-limiting examples, the outer shell is constructed of a hard material that encloses the cell (e.g. steel).

As used herein, "anode assembly", means: an assembly for retaining at least one anode. In some embodiments, the anode assembly includes: an anode support and a plurality of anodes.

As used herein, "cathode assembly" means an assembly for retaining at least one cathode. In some embodiments, the cathode assembly includes a cathode support and a plurality of cathodes.

As used herein, "current" means: electrical direct current.

In some embodiments, "cell resistance" means: the electrical resistance of an electrolysis cell.

In some embodiments, "signal" means: an electrical impulse indicative of a measurement.

In some embodiments, "cell resistance signal" means: an electrical impulse indicative of the electrical resistance in an electrolysis cell.

As used herein, "producing" (e.g. making) means: In some embodiments, one or more methods of the instant disclosure include the step of producing a metal product from the molten electrolyte bath (e.g. aluminum metal).

FIG. 1 shows a schematic cross-section of an electrolytic cell 100 for producing aluminum metal by the electrochemical reduction of alumina using an anode and a cathode. In some embodiments, the anode is an inert anode. Some non-limiting examples of inert anode compositions include: ceramic, metallic, cermet, and/or combinations thereof. Some non-limiting examples of inert anode compositions are provided in U.S. Pat. Nos. 4,374,050, 4,374,761, 4,399,008, 4,455,211, 4,582,585, 4,584,172, 4,620,905, 5,279,715, 5,794,112 and 5,865,980, assigned to the assignee of the present application. In some embodiments, the anode is an oxygen-evolving electrode. An oxygen-evolving electrode is an electrode that produces oxygen during electrolysis. In some embodiments, the cathode is a wettable cathode. In some embodiments, aluminum wettable materials are materials having a contact angle with molten aluminum of not greater than 90 degrees in the molten electrolyte. Some non-limiting examples of wettable materials may comprise one or more of $TiB_2$, $ZrB_2$, $HfB_2$, $SrB_2$, carbonaceous materials, and combinations thereof.

The electrolytic cell 100 has at least one anode module 102. In some embodiments, the anode module 102 has at least one anode 104. The electrolytic cell 100 further comprises at least one cathode module 106. In some embodiments, the cathode module 106 has at least one cathode 108. In some embodiments, the at least one anode module 102 is suspended above the at least one cathode module 106. The cathode 108 is positioned in the cell reservoir 110. The cathodes 108 extend upwards towards the anode module 102. While anodes 104 and cathodes 108 of a specific number are shown in the various embodiments of the present disclosure, any number of anodes 104 and cathodes 108 greater than or equal to 1 may be used to define an anode module 102 or a cathode module 106, respectively. The cell reservoir 110 typically has a steel shell 118 and is lined with insulating material 120, refractory material 122 and sidewall material 124. The cell reservoir 110 is capable of retaining a bath of molten electrolyte (shown diagrammatically by dashed line 126) and a molten aluminum metal pad therein. Portions of an anode bus 128 that supplies electrical current to the anode modules 102 are shown pressed into electrical contact with anode rods 130 of the anode modules 102. The anode rods 130 are structurally and electrically connected to an anode distribution plate 132, to which a thermal insulation layer 134 is attached. The anodes 104 extend through the thermal insulation layer 134 and mechanically and electrically contact the anode distribution plate 132. The anode bus 128 would conduct direct electrical current from a suitable power source 136 through the anode rods 130, the anode distribution plate 132, anode elements, and electrolyte 126 to the cathodes 108 and from there through the cathode support 112, cathode blocks 114 and cathode current collector bars 116 to the other pole of the power source of electricity 136. The anodes 104 of each anode module 102 are in electrical continuity. Similarly, the cathodes 108 of each cathode module 106 are in electrical continuity. The anode modules 102 may be raised and lowered by a positioning apparatus to adjust their position relative to the cathode modules 106 to adjust the anode-cathode overlap (ACO).

In some embodiments, the cathodes 108 are supported in a cathode support 112. In some embodiments, the cathode support 112 is retained on a bottom of the cell reservoir 110. In some embodiments, the cathode supports 112 are fixedly coupled to the bottom of the electrolytic cell 100. In some embodiments, the cathode support 112 contacts at least one of a metal pad or a molten electrolyte bath 126 within the cell reservoir 110. In some embodiments, the cathode support 112 rests on cathode blocks 114, e.g., made from carbonaceous material in electrical continuity with one or more cathode current collector bars 116. In some embodiments, the cathode blocks 114 are fixedly coupled to the bottom of the electrolytic cell 100. In some embodiments, the cathode support 112 is integrally formed with the cathode blocks 114, wherein the cathode block 114 is part of the cathode support 112. In some embodiments, the cathode support 112 is coupled to the cathode blocks 114.

In some embodiments, the cathode support 112 comprises a body having a support bottom. In some embodiments, the support bottom is configured to be in communication with the bottom of the electrolysis cell. The body of the cathode support 112 further comprises a support top, opposite the support bottom, having a cathode attachment area configured to retain a plurality of cathode plates therein.

Figure 2:
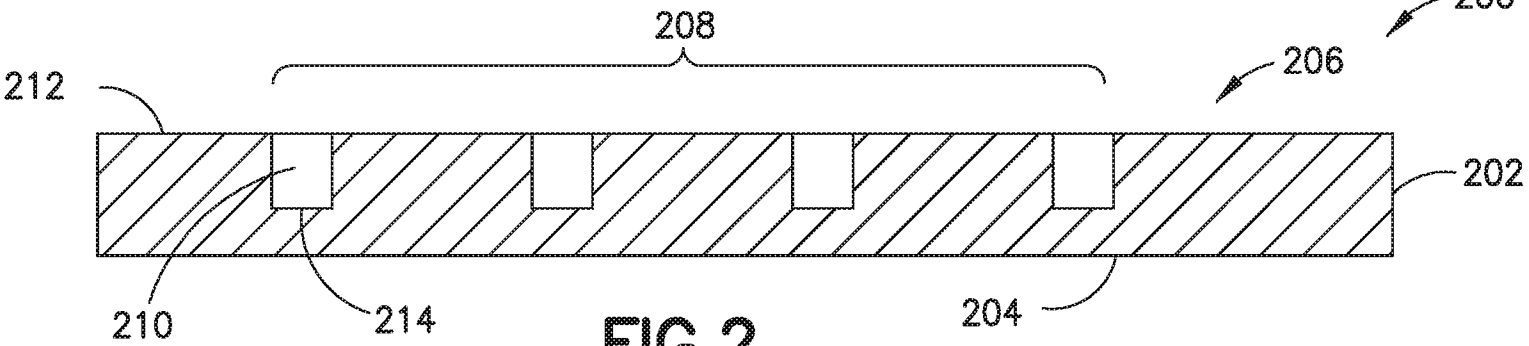
FIG. 2 is a cross section of a cathode attachment area of a cathode support in accordance with an embodiment of the present disclosure.
Figure 3:
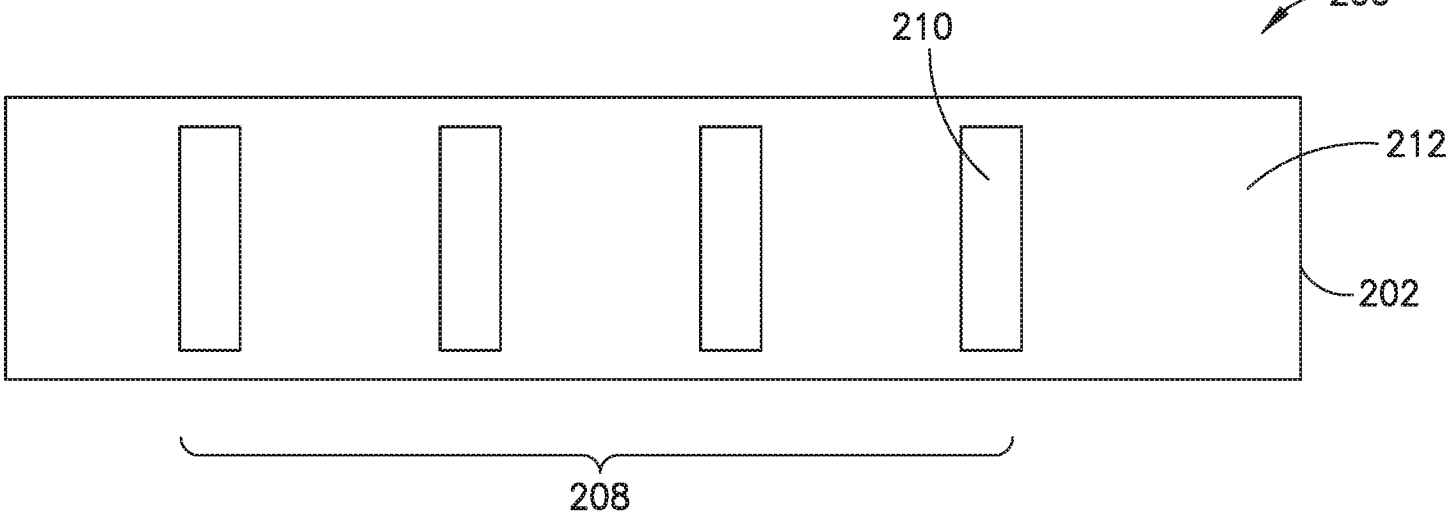
FIG. 3 is a top view of the cathode support shown in FIG. 2 in accordance with an embodiment of the present disclosure.

FIG. 2 depicts a cross section of a cathode attachment area of a cathode support in accordance with an embodiment of the present disclosure. FIG. 3 depicts a top view of the cathode support shown in FIG. 2 in accordance with an embodiment of the present disclosure. In some embodiments, as depicted in FIG. 2 and FIG. 3, a cathode block 200 comprises a body 202 having a support bottom 204, configured to be in communication with the bottom of the electrolysis cell, and a support top 206 opposite the support bottom 204. The support top 206 comprises a cathode attachment area 208. The cathode attachment area 208 comprises at least one surface groove 210 formed in the upper surface 212 of the cathode block 200. Each groove 210 is configured to a sufficient depth to retain a cathode plate (not shown in FIGS. 2 and 3). In some embodiments, the depth of the groove 210, as measured from the upper surface 212 to a bottom 214 of the groove 210 is from about 1 inches to about 8 inches, or about 2 inches to about 8 inches, or about 3 inches to about 8 inches, or about 4 inches to about 8 inches, or about 5 inches to about 8 inches, or about 6 inches to about 8 inches, or about 7 inches to about 8 inches, or about 1 inches to about 7 inches, or about 1 inches to about 6 inches, or about 1 inches to about 5 inches, or about 1 inches to about 4 inches, or about 1 inches to about 3 inches, or about 1 inches to about 2 inches. In some embodiments, the length and width of the groove 210 are dependent on the length and thickness of the cathode plate that will be retained in the groove 210. In some embodiments, the length and width of the groove 210 matches the corresponding dimension of the cathode. In some embodiments, the cathode plate has a thickness of about ⅛ inches to about 1 inches, or about ¼ inches to about 1 inch, or about ½ inches to about 1 inch, or about ⅛ inches to about ½ inches, or about ⅛ inches to about ¼ inches.

Figure 4:
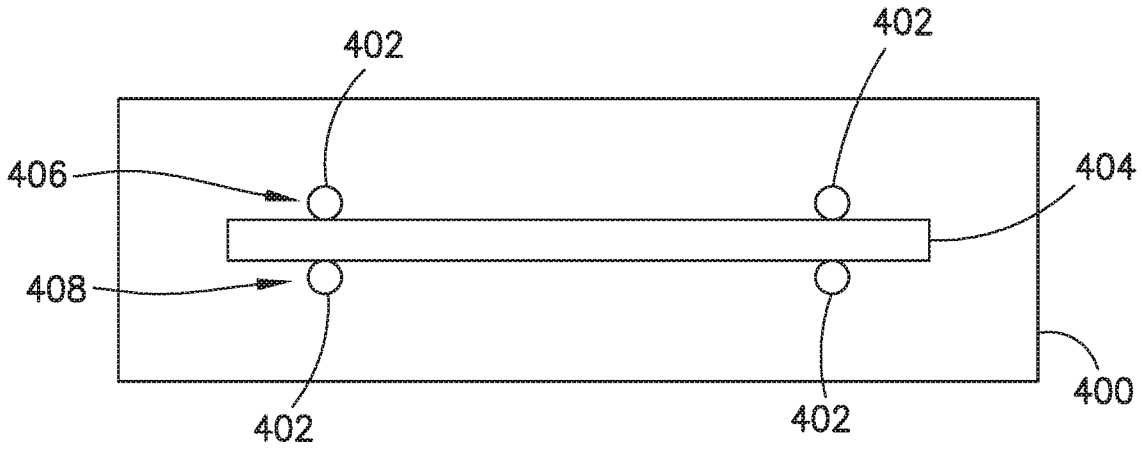
FIG. 4 is a top view of pins supporting a cathode in a cathode block in accordance with an embodiment of the present disclosure.
Figure 5:
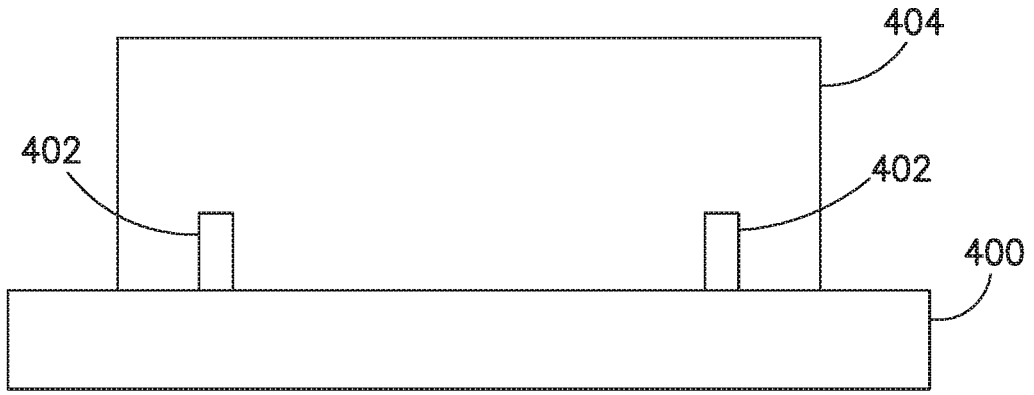
FIG. 5 is a front view of the embodiment shown in FIG. 4.
Figure 6:
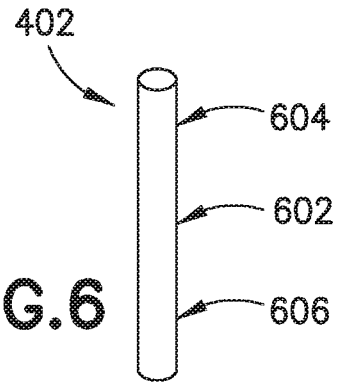
FIG. 6 is a perspective view of a pin in accordance with an embodiment of the present disclosure.

In some embodiments, the cathode support comprises a plurality of pins. FIG. 4 depicts a top view of a plurality of pins 402 supporting a cathode plate 404 in a cathode block 400 according to one embodiment. In some embodiments, the cathode plate 404 is planar and supported in a vertical configuration. In some embodiments, the cathode plate 404 is non-planar and supported in a vertical configuration. FIG. 5 is a front view of the embodiment shown in FIG. 4. In some embodiments, as depicted in FIG. 6, a pin 402 comprises a body 602, a pin top 604 and a pin bottom 606. In some embodiments, the body 602 is comprised of titanium diboride ($TiB_2$). In some embodiments, the body 602 is comprised of the same material as the cathode plates.

Figure 7:
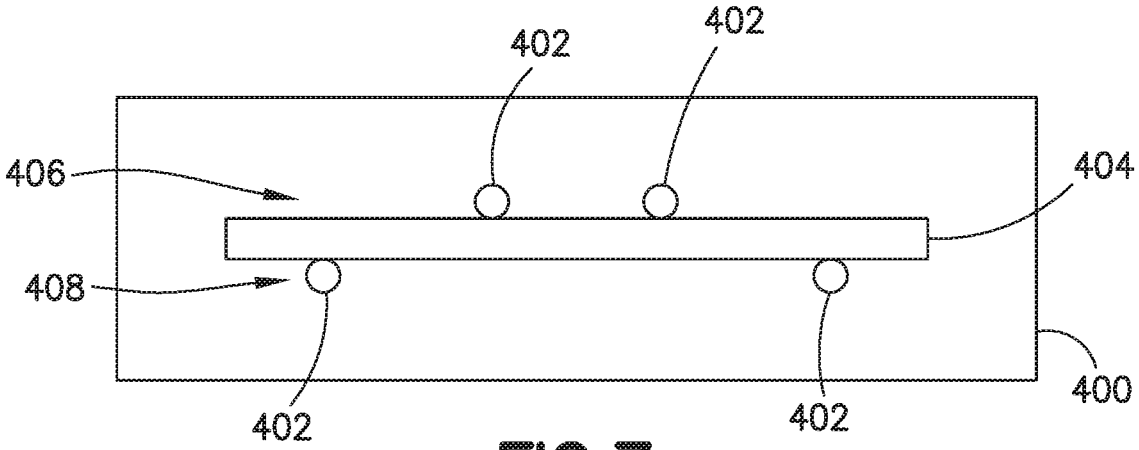
FIG. 7 is a top view of pins supporting a cathode in a cathode block in accordance with an embodiment of the present disclosure.
Figure 8:
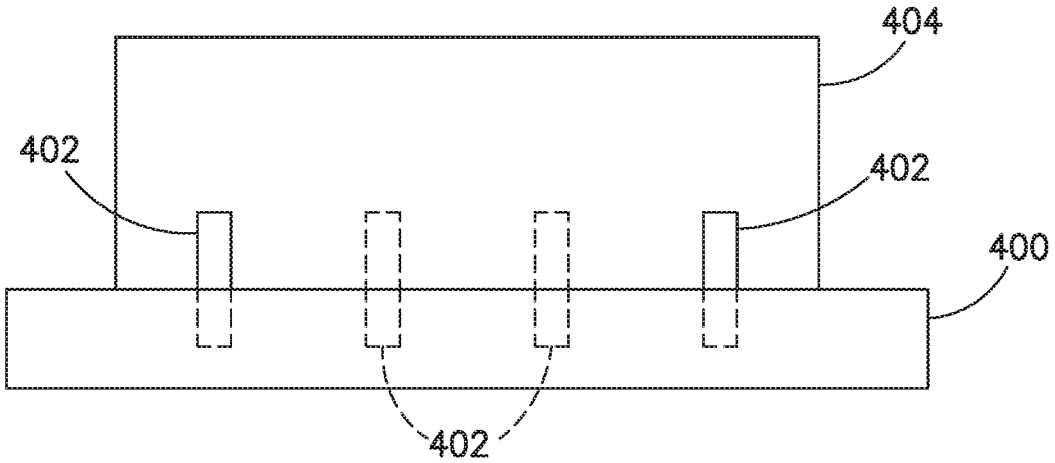
FIG. 8 is a front view of the embodiment shown in FIG. 7.
Figure 9:
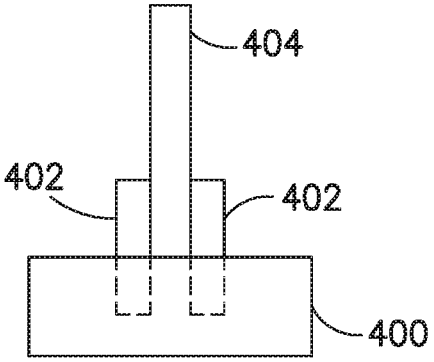
FIG. 9 is a side view of the embodiment shown in FIGS. 7 and 8.
Figure 10:
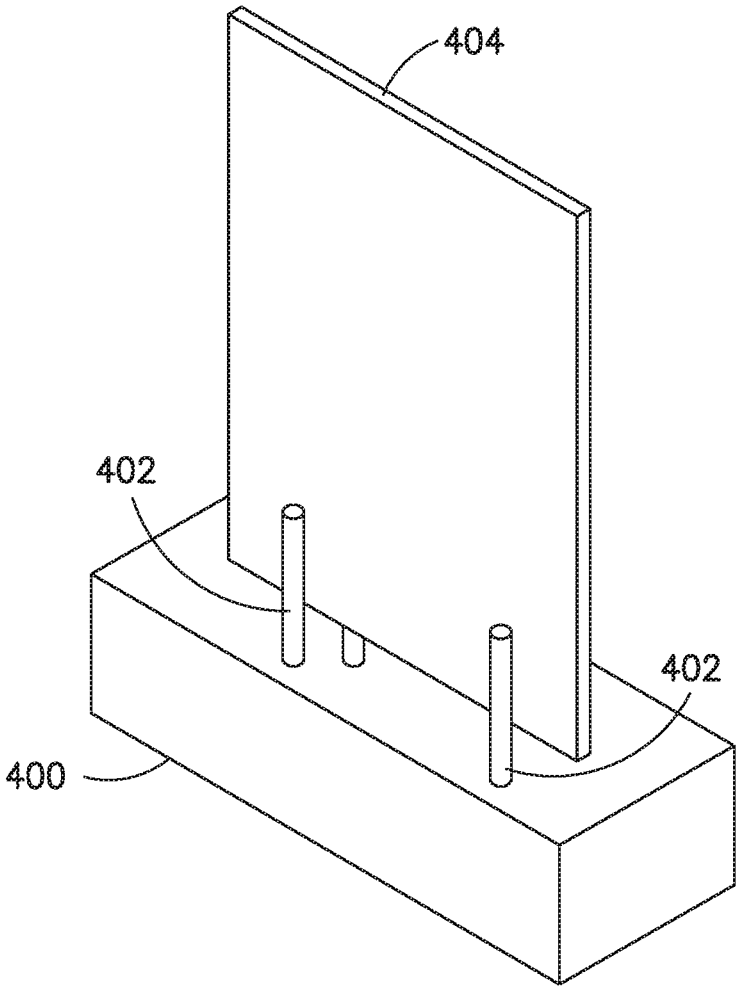
FIG. 10 is a perspective view of the embodiment shown in FIGS. 7, 8 and 9.

In some embodiments, as depicted in FIGS. 7-10, each pin bottom 606 is retained by either the bottom of the electrolysis cell or the cathode block. FIG. 7 is a top view of pins 402 supporting a cathode plate 404 in a cathode block 400 in accordance with an embodiment of the present disclosure. FIG. 8 is a front view of the embodiment shown in FIG. 7. FIG. 9 is a side view of the embodiment shown in FIGS. 7 and 8. FIG. 10 is a perspective view of the embodiment shown in FIGS. 7, 8 and 9. In some embodiments, as depicted in FIGS. 7-10, the pin tops 604 are configured in a spaced relation to each other to support a cathode plate 404. In some embodiments, the pin bottoms 606 are embedded within corresponding openings in the cathode support.

In some embodiments, the pins 402 are placed in holes that are drilled directly into the cathode block 400. In some embodiments, the diameter of the holes is substantially equal to the diameter of one of the entire pin 402 or of the pin bottom 606. In some embodiments, the diameter of the hole that retains the pin bottom 606 is larger than diameter of the pin bottom 606. In some embodiments, as the pin 402 heats up during operation of the electrolytic cell, the expansion of the pin 402 is greater than the expansion of the hole, thereby resulting in a tight fit of the pin 402 within the corresponding hole.

In some embodiments, as depicted in FIG. 4-5 and FIG. 7-10, the plurality of pins 402, includes a first set of pins 406 and a second set of pins 408. In some embodiments, one of the first set of pins 406 or the second set of pins 408 is two or more pins 402 and the other is one or more pins 402. In some embodiments, the combination of the first set of pins 406 and the second set of pins 408 is three or more pins 406. In some embodiments as depicted in FIG. 4-5 and FIG. 7-10, the first set of pins 406 is two pins 402 and the second set of pins 408 is two pins 402.

In some embodiments, as shown in FIG. 4-5 and FIG. 7-10, the pin bottoms of the first set of pins 406 are arranged in a linear formation on the cathode block 400 (e.g. the cathode support). In some embodiments, as shown in FIG. 4-5 and FIG. 7-10, the pin bottoms of the second set of pins 408 are arranged in a linear formation on the cathode block 400. In some embodiments, the linear formation of the pin bottoms of the first set of pins 406 is parallel to the linear formation of the pin bottoms of the second set of pins 408. In some embodiments, as shown in FIG. 4-5, the first set of pins 406 and the second set of pins 408 are located on opposite sides of the cathode block 400 at substantially the same position of the cathode block 400. In some embodiments, as shown in FIG. 7-10, the first set of pins 406 and the second set of pins 408 are located on opposite sides of the cathode block 400 at off-set positions relative to each other.

Figure 11:
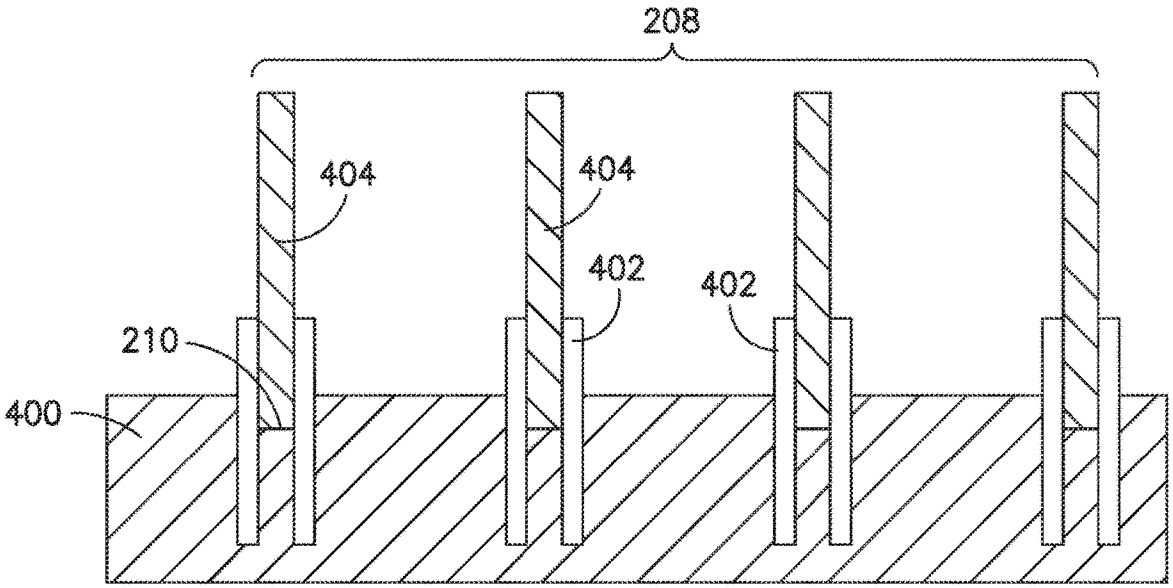
FIG. 11 is a cross section view of pins supporting cathodes embedded in a cathode block in accordance with an embodiment of the present disclosure.
Figure 12:
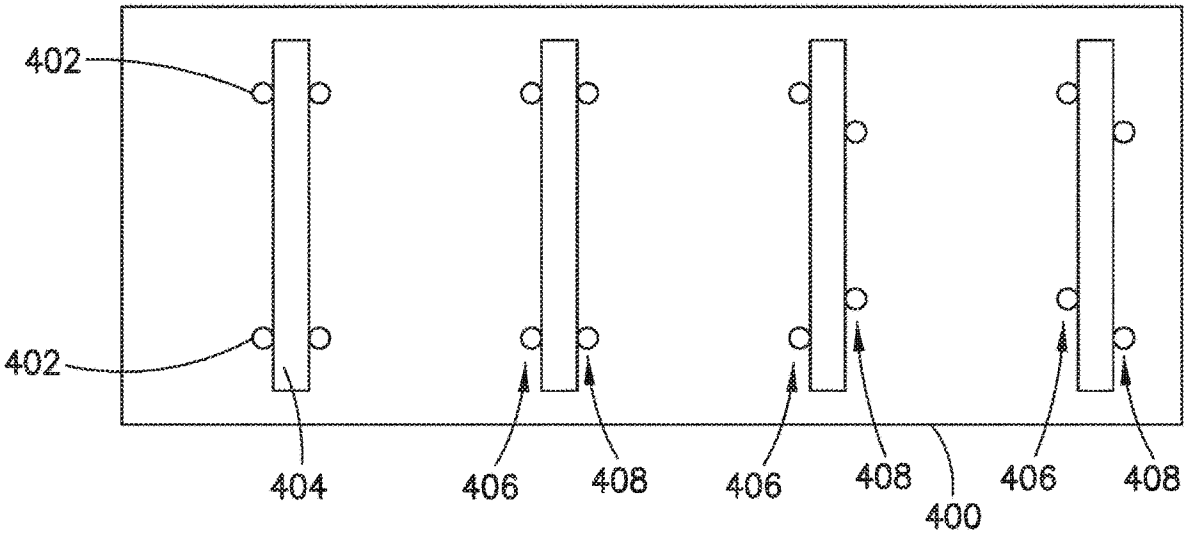
FIG. 12 is a top view of the cathode block shown in FIG. 8.

In some embodiments, the cathode plate can be supported by a plurality of pins as discussed above with respect to FIG. 4-5 and FIG. 7-10 and can be embedded in grooves formed in the cathode block as discussed with respect to FIG. 2-3. FIG. 11 is a cross section view of a plurality of pins 402 supporting cathodes plates 404 that are embedded in a cathode block 400. The cathode block 400 comprises a cathode attachment area 208. The cathode attachment area 208 comprises surface grooves 210 formed in the upper surface 212 of the cathode block 200. A portion of the cathode plate 404 is retained in the surface grooves 210. FIG. 12 is a top view of the cathode block shown in FIG. 11. In some embodiments, as shown in FIG. 12, some cathode plates 404 are supported by a first set of pins 406 and a second set of pins 408 located on opposite sides of the cathode plate 404 at substantially the same position on the cathode block 400, while other cathode plates 404 are supported by a first set of pins 406 and a second set of pins 408 located on opposite sides of the cathode plate 404 at off-set positions relative to each other.

Figure 13:
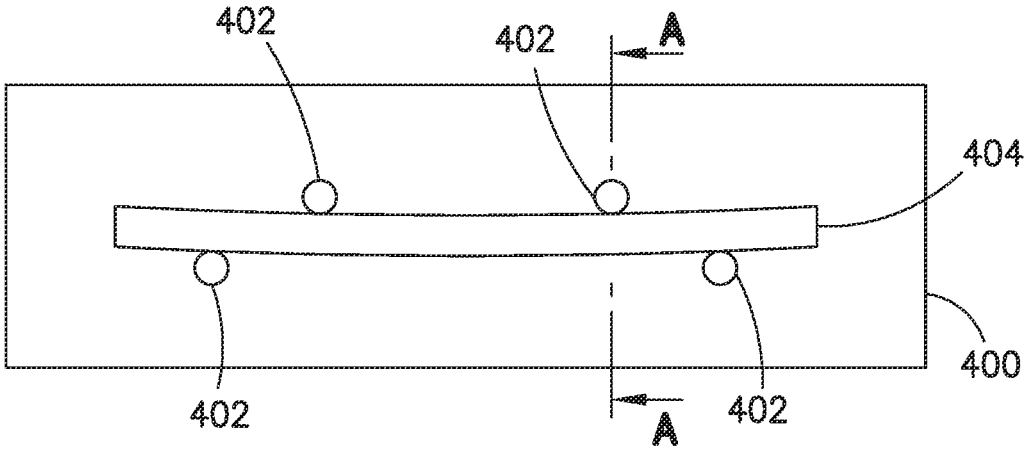
FIG. 13 is a top view of pins supporting a cathode in a cathode block in accordance with an embodiment of the present disclosure.
Figure 14:
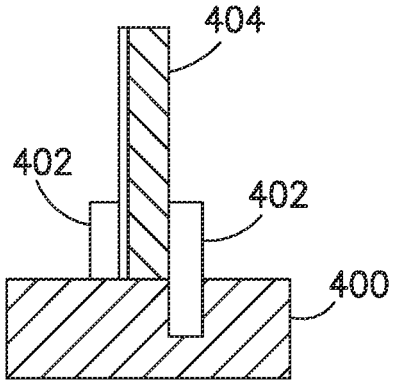
FIG. 14 is a cross section view along line A-A of the embodiment shown in FIG. 13.
Figure 15:
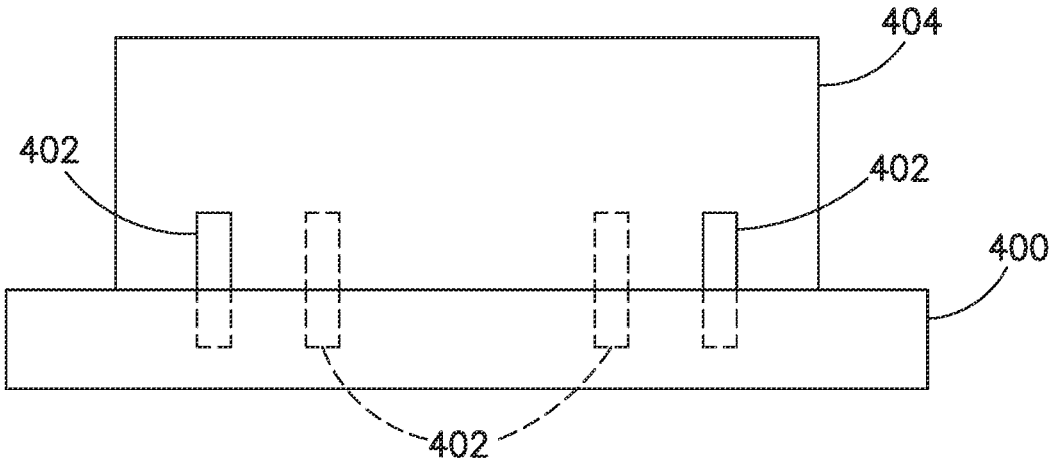
FIG. 15 is a front view of the embodiment shown in FIG. 13.
Figure 16:
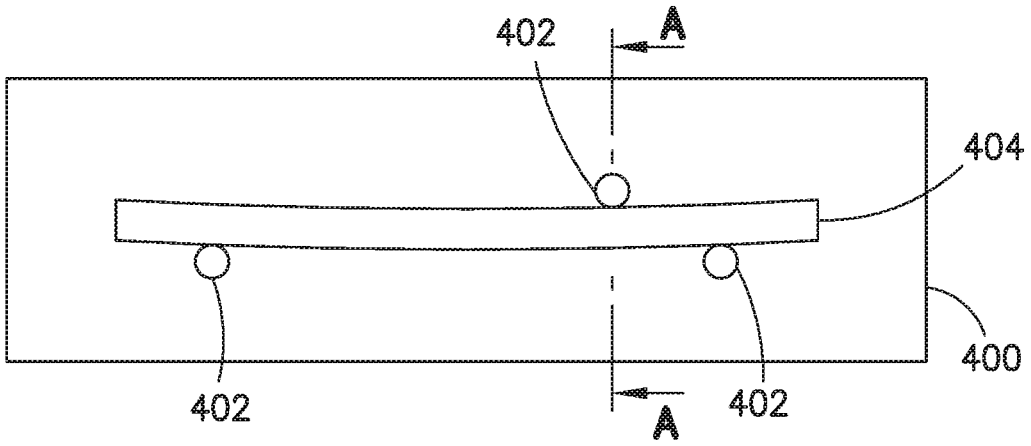
FIG. 16 is a top view of pins supporting a cathode in a cathode block in accordance with an embodiment of the present disclosure.
Figure 17:
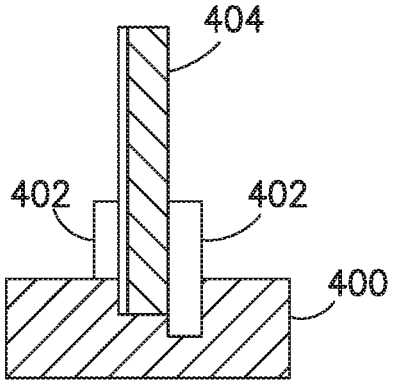
FIG. 17 is a cross section view along line A-A of the embodiment shown in FIG. 16.
Figure 18:
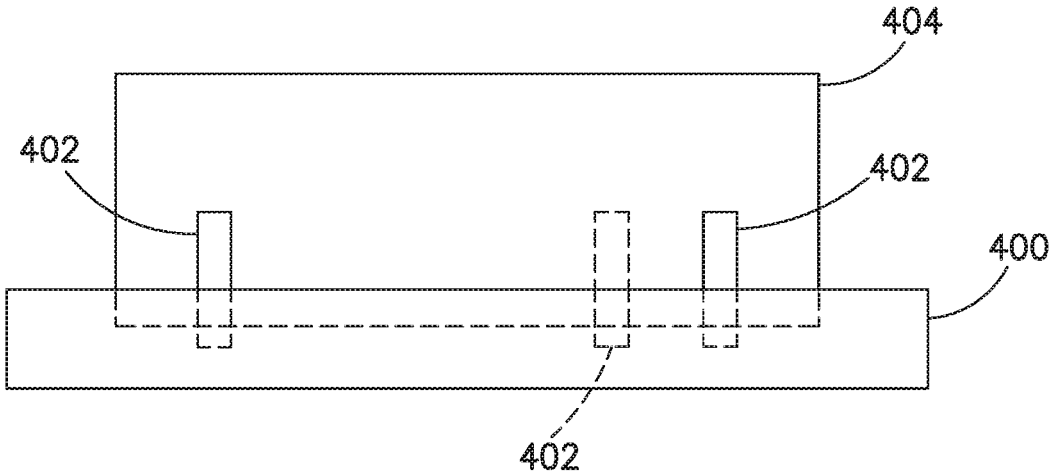
FIG. 18 is a front view of the embodiment shown in FIG. 16.

In some embodiments, the cathode plate is non-planar. FIG. 13 and FIG. 16 depict a top view of a plurality of pins 402 supporting a non-planar cathode plate 404 in a cathode block 400 according to a further embodiment of the present disclosure. FIG. 13 depicts an embodiment using a total of four pins to support the cathode plate 404, with two pins on one side of the cathode plate 404 and two pins on an opposing side of the cathode plate 404. FIG. 16 depicts an embodiment using a total of three pins to support the cathode plate, with two pins on one side of the cathode plate 404 and one pin on an opposing side of the cathode plate 404. FIG. 14 is a cross section view along line A-A of the embodiment shown in FIG. 13. FIG. 15 is a front view of the embodiment shown in FIG. 13. FIG. 17 is a cross section view along line A-A of the embodiment shown in FIG. 16. FIG. 18 is a front view of the embodiment shown in FIG. 16.

In some embodiments, the pin tops of the pins are configured to support the non-planar cathode plate in a vertical configuration. In some embodiments, the first set of pins and the second set of pins each comprises a first pin having a pin top with a first shape and a second pin having a pin top with a second shape, wherein the first shape is different than the second shape. In some embodiments, the pin top of the first pin has a first diameter and the pin top of the second pin has a second diameter. In some embodiments, the first diameter is different than the second diameter. In some embodiments, the pin tops 604 have a laterally non-symmetrical shape. In some embodiments, the pin top 604 of at least one of the plurality of pins has a varying radius.

Figure 19:
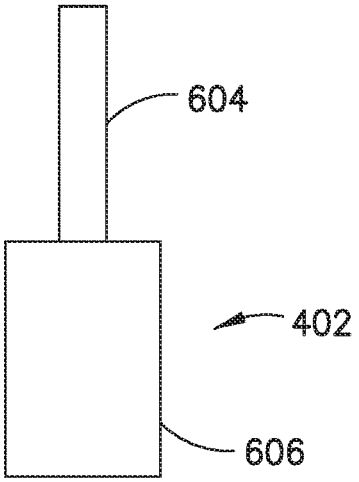
FIGS. 19-24 show examples of shapes of pins in accordance with an embodiment of the present disclosure.
Figure 20:
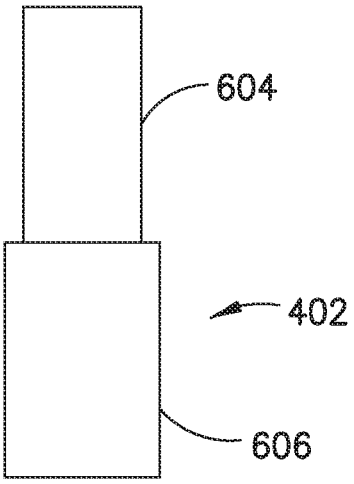
Figure 21:
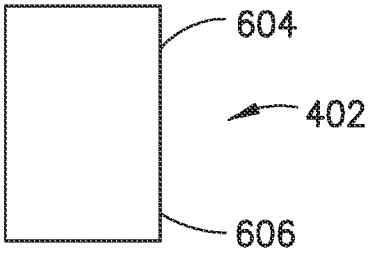
Figure 22:
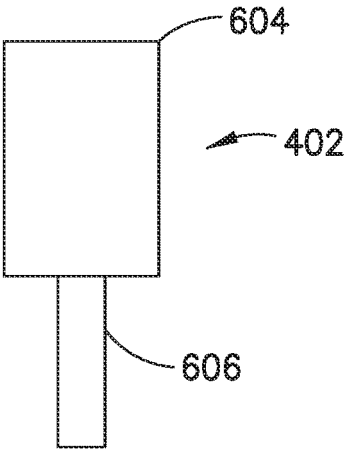
Figure 23:
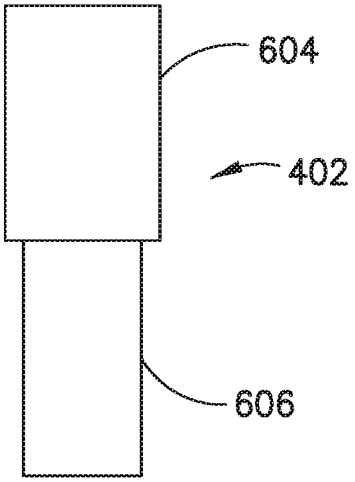
Figure 24:
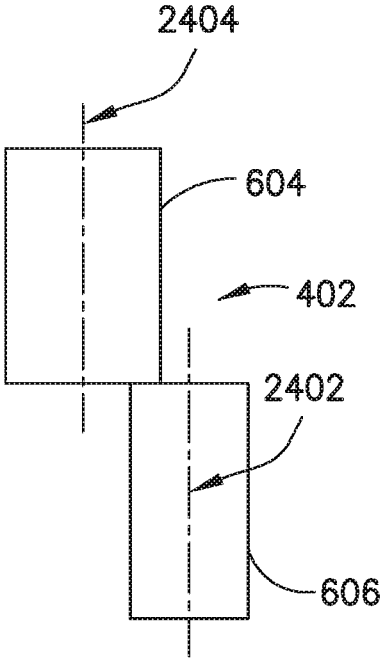

FIGS. 19-24 show examples of shapes of pins that can be used in certain embodiments, for example in embodiments where the cathode plate is non-planar. The shape of the pin is dependent on the curvature of the non-planar cathode plate at the position on the cathode block where the pin is to be embedded. For example, FIG. 19-20 shows an exemplary pin 402, having a pin bottom 606 with a first diameter and a pin top 604 having a second diameter that is less than the first diameter. In some embodiments, the second diameter is about 0.02 inches less than the first diameter or in some embodiments 0.01 inches less than the first diameter. FIG. 21 shows an exemplary pin 402 having a pin bottom 606 with a first diameter and a pin top 604 having a second diameter that is the same, or substantially the same as the first diameter. FIG. 22-23 shows an exemplary pin 402, having a pin bottom 606 with a first diameter and a pin top 604 having a second diameter that is greater than the first diameter. In some embodiments, the second diameter is about 0.02 inches greater than the first diameter or in some embodiments 0.01 inches greater than the first diameter. FIG. 24 depicts an exemplary pin 402, having a pin bottom 606 and a pin top 604, wherein the centerline 2402 of the pin bottom 606 is offset from the centerline 2404 of the pin top 604. In some embodiments, the exemplary pin 402 of FIG. 24 has a varying radius. In some embodiments, the exemplary pin 402 of FIG. 24 rotates within an opening formed in the cathode block until a desired clearance between the pin and the cathode plate is achieved. In some embodiments, the pin bottom 606 and the pin top 604 of the pins 402 shown in FIGS. 19-24 are integrally formed.

In some embodiments, the pin bottom 606 is embedded into the cathode block 400 and the pin top 604 comprises two prongs, wherein the cathode plate is positioned between the two prongs.

Figure 25:
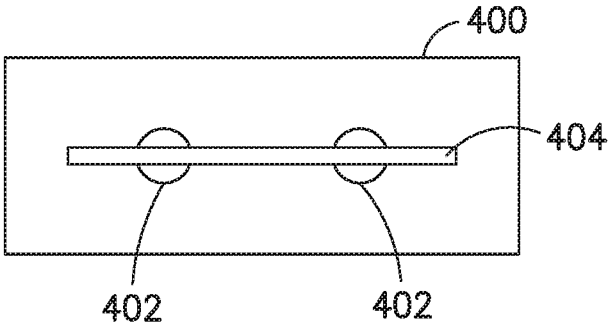
FIG. 25 is a top view of pins supporting a cathode in a cathode block in accordance with an embodiment of the present disclosure.
Figure 26:
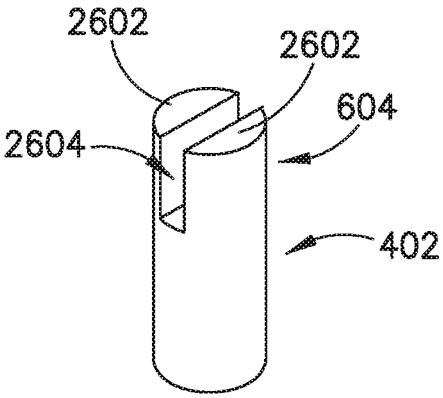
FIG. 26 is a perspective view of one of the pins shown in FIG. 25.
Figure 27:
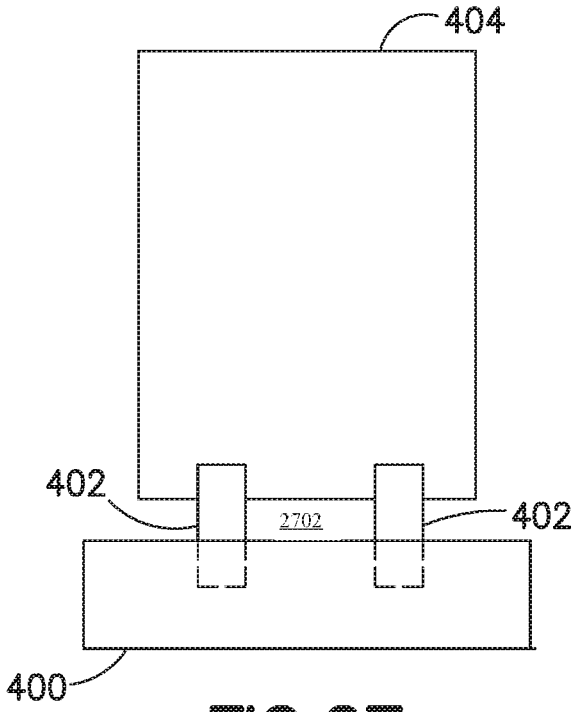
FIG. 27 is a front view of the embodiment shown in FIG. 25.
Figure 28:
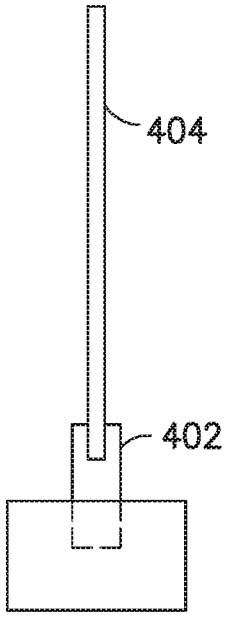
FIG. 28 is a side view of the embodiment shown in FIGS. 25 and 27.
Figure 29:
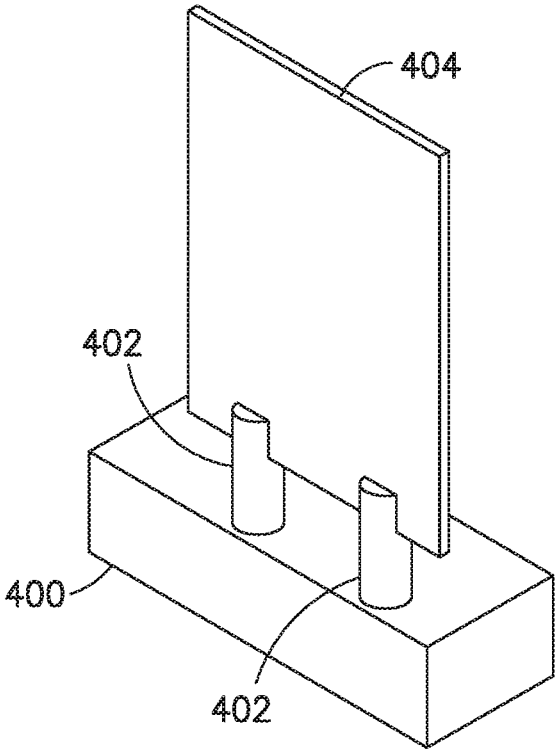
FIG. 29 is a perspective of the embodiment shown in FIGS. 25, 27 and 28.
Figure 30:
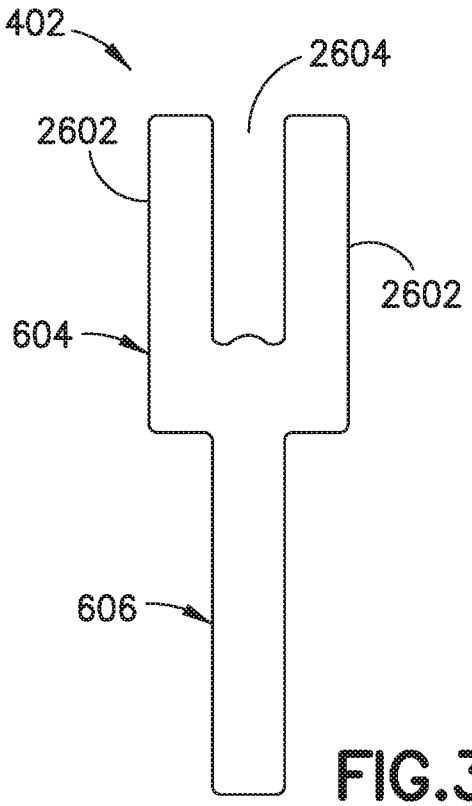
FIGS. 30 and 31 show a front view and a perspective view of a pin that can be used in accordance with an embodiment of the present disclosure.
Figure 31:
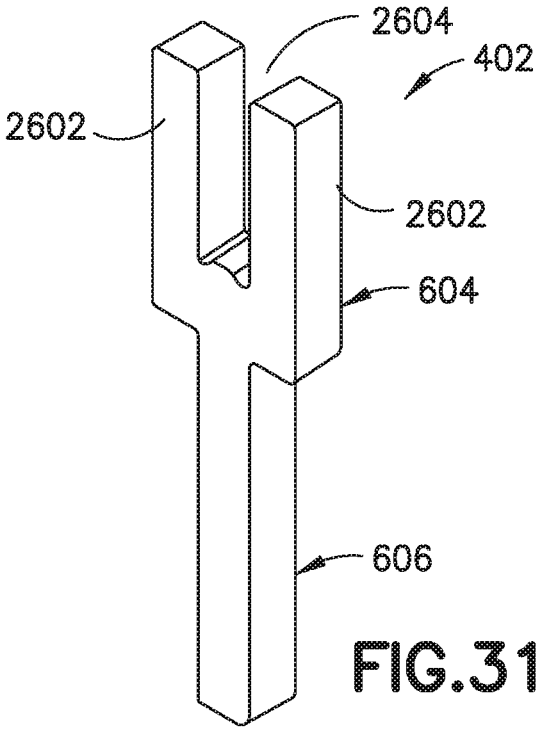
Figure 32:
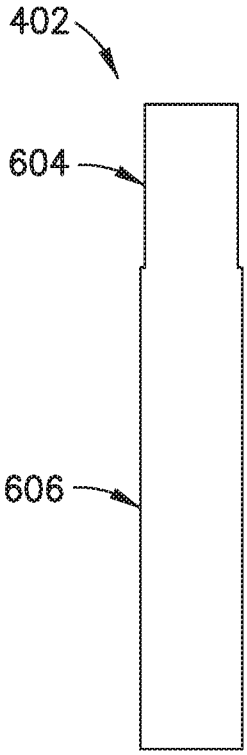
FIGS. 32-35 show different views of another pin that can be used in accordance with an embodiment of the present disclosure.
Figure 33:
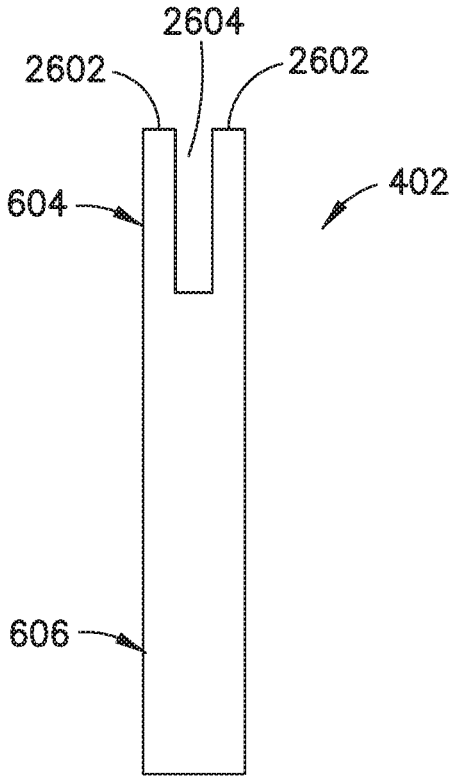
Figure 34:
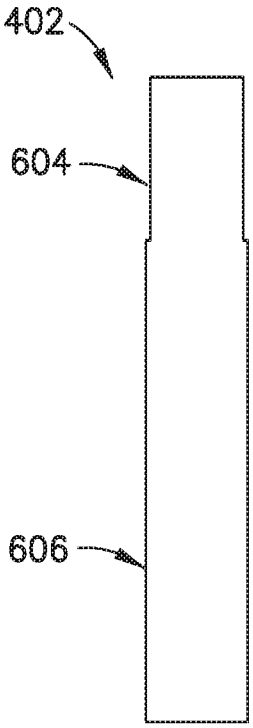
Figure 35:
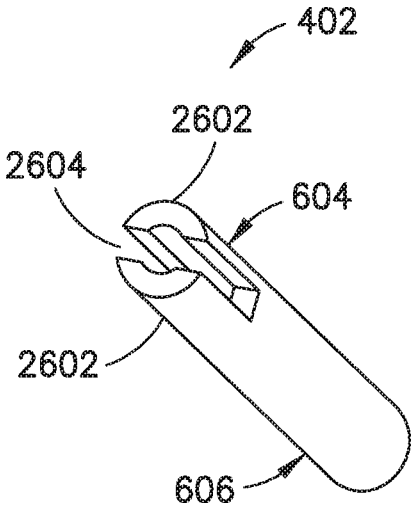
Figure 36:
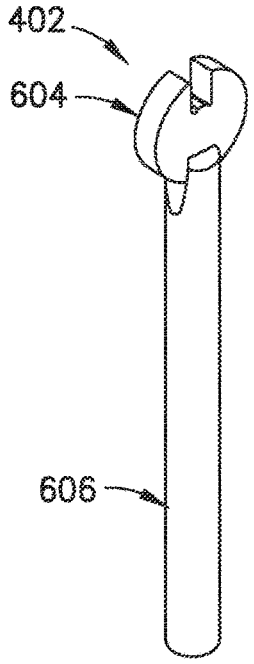
FIGS. 36-41 show different views of yet another pin that can be used in accordance with an embodiment of the present disclosure.
Figure 37:
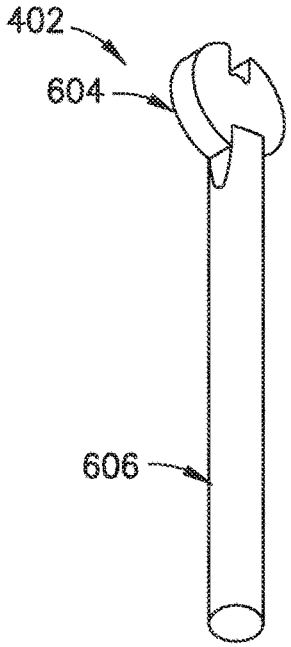
Figure 38:
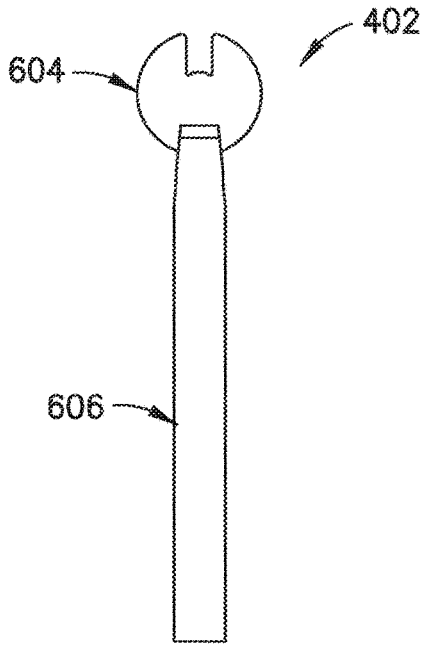
Figure 39:
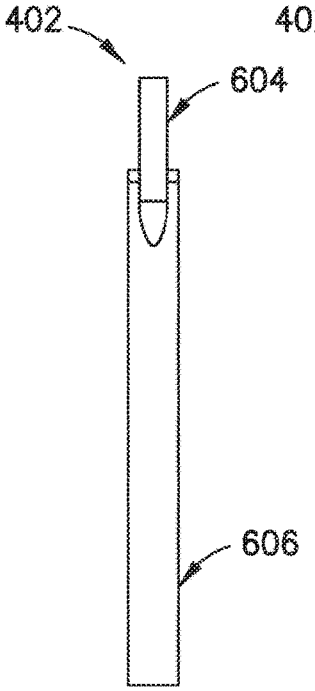
Figure 40:
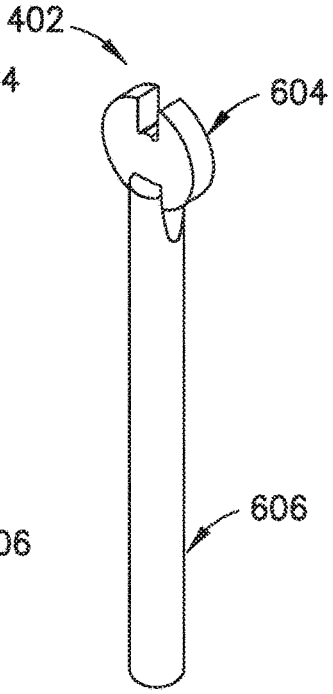

FIG. 25 is a top view of pins 402 comprising two prongs supporting a cathode plate 404 in a cathode block 400 according to a further embodiment. Each pin 402 has two prongs in the pin top 604 and the cathode plate 404 rests between the two prongs. FIG. 26 is a perspective view of one of the pins 402 shown in FIG. 25. The pin 402 in FIG. 26 comprises two prongs 2602 (i.e. opposing vertically extending portions) at the pin top 604 defining a space 2604 therebetween to retain a cathode plate. FIG. 27 is a front view of the embodiment shown in FIG. 25. FIG. 27 depicts the cathode plate 404 raised above the cathode block 400 by the pins 402 forming a flow through portion 2702 under the cathode plate 404 and between the pins 402. The flow through portion 2702 provides a flow path for at least one of a metal product and an electrolyte bath. FIG. 28 is a side view of the embodiment shown in FIGS. 25 and 27. FIG. 29 is a perspective of the embodiment shown in FIGS. 25, 27 and 28.

FIGS. 30-31 and FIGS. 32-35 show various views of a pin having two prongs that can be used in some embodiments. The pin 402 shown in FIG. 30 and FIG. 31 comprises a pin bottom 606 that fits into an opening formed in the cathode block and a pin top 604 having two prongs 2602 (i.e. vertically extending opposing portions) at the pin top 604 defining a space 2604 therebetween to retain a cathode plate.

Figure 41:
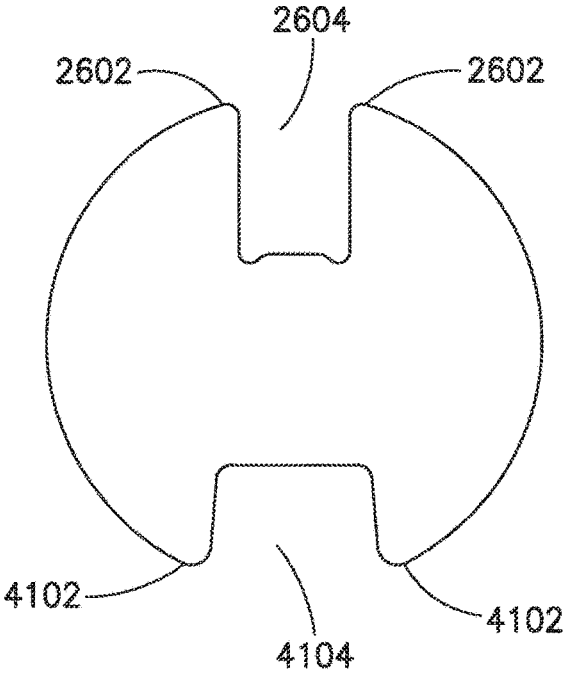

FIGS. 36-41 shows various views of a pin having two prongs that can be used in some embodiments. FIG. 36-40 show a pin 402 having a pin bottom 606 that fits into an opening formed in the cathode block and a pin top 604. FIG. 41 shows the pin top 604 having a circular body with two prongs 2602 at a first end (i.e. vertically extending opposing portions) defining a space 2604 therebetween to retain a cathode plate and two prongs 4102 at an opposing second end, defining a space 4104 therebetween, to couple to a notch in the pin 402.

Figure 42:
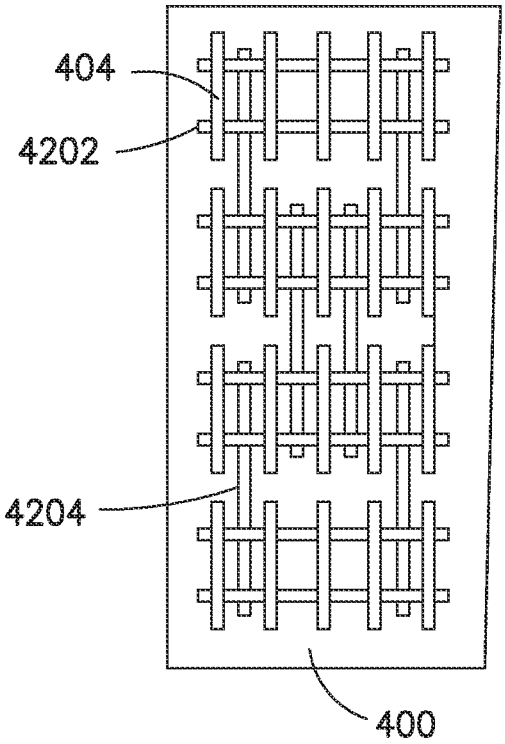
FIG. 42 shows a cathode support in accordance with an embodiment of the present disclosure.
Figure 43:
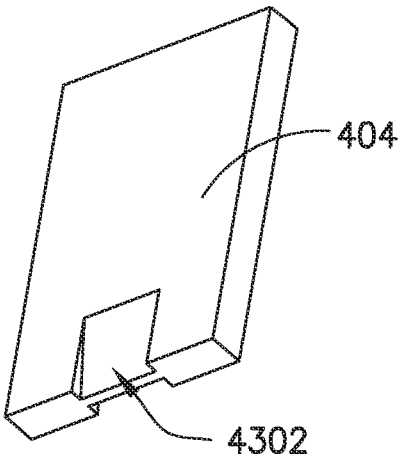
FIG. 43 is a partial front cross section view of a cathode entering the cathode support of FIG. 42.
Figure 44:
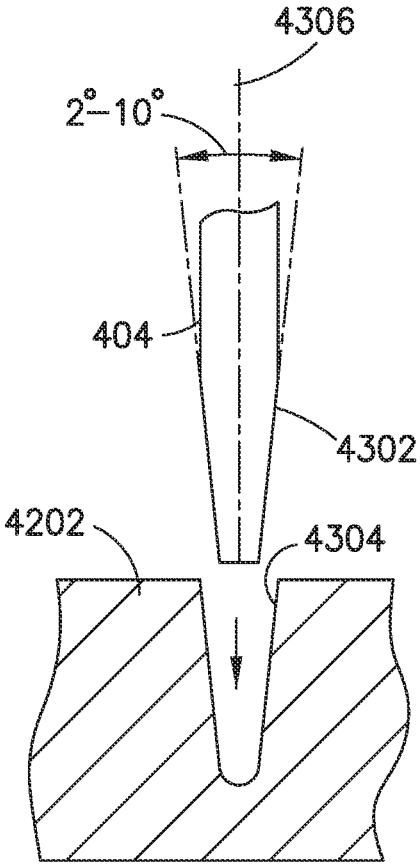
FIG. 44 shows a bottom perspective view of the cathode shown in FIG. 43.

In some embodiments, the cathode support comprises a series of beams mounted to the cathode block. FIG. 42 shows a cathode block 400 comprising a series of beams mounted to the cathode block 400 according to one embodiment of the present disclosure. The series of beams includes cross beams 4202 and connector beams 4204. In some embodiments, the cross beams 4202 and the connector beams 4204 are made of titanium diboride. In some embodiments, portions of the cathode plates 404 are wedge shaped to fit within grooves in the cross beams 4202. In some embodiments, as depicted in FIG. 42, the cathode plates 404 are configured in a spaced end-to-end relation/configuration relative to each other. In some embodiments, the cathode plates 404 can be positioned such that the end/edge of one cathode plate touches the end/edges of cathode plates which oppose it on either side. FIG. 43 is a partial front cross section view of a cathode plate 404 having a wedge 4302 at a bottom of the cathode plate entering a groove 4304 in the cross beam 4202 of FIG. 42. The wedge has a taper of about 2 to about 10 degrees from the centerline 4306. FIG. 44 shows a bottom perspective view of the cathode plate with a wedge as shown in FIG. 43.

Figure 49:
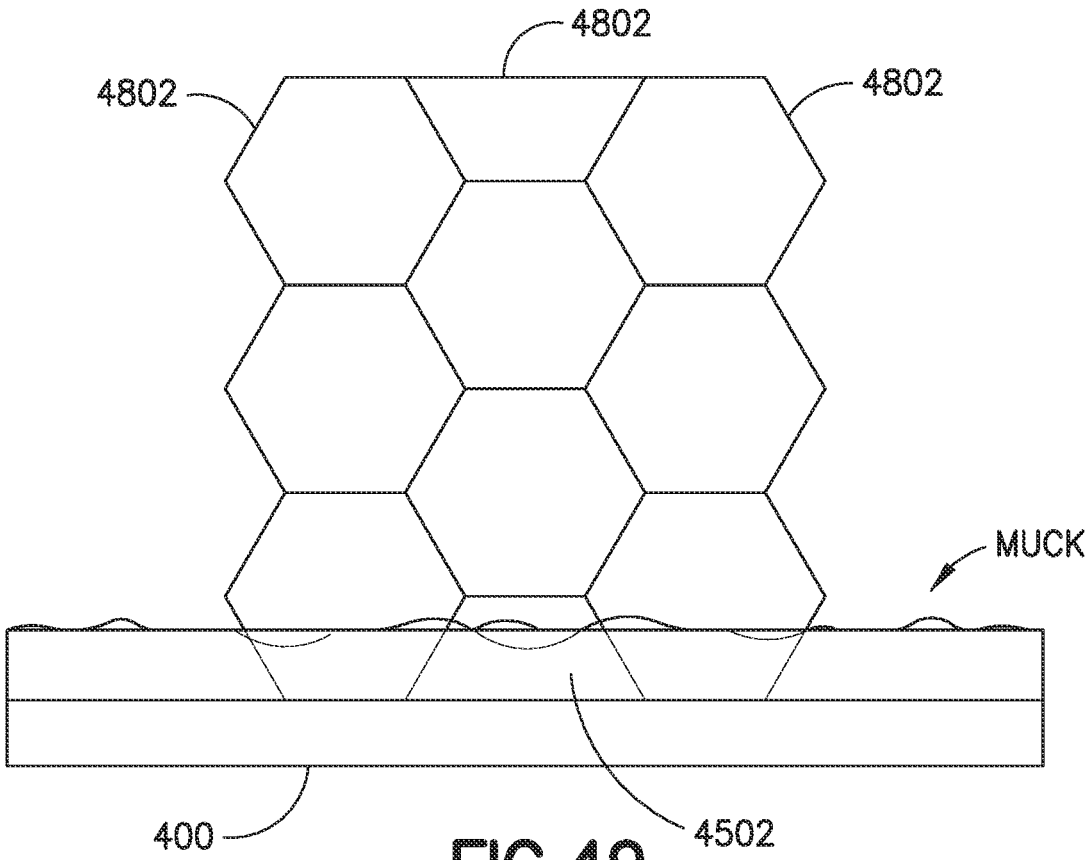
FIG. 49 shows another embodiment of a cathode formed from an array of cathode tiles in accordance with an embodiment of the present disclosure.

FIG. 49 shows another embodiment of a cathode formed from an array of cathode tiles. Each tile is interlocked to adjacent tiles. In some embodiments, two or more tiles are attached to the cathode block. The tiles above the muck may be reused as they will not be stuck in the muck when the cell cools.

Figure 45:
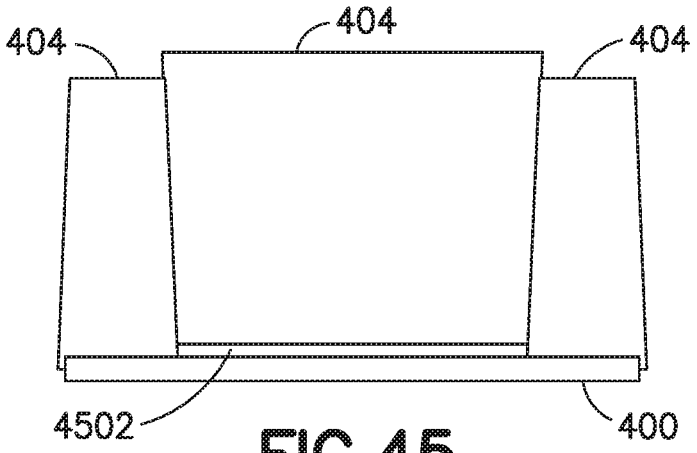
FIG. 45 is a front view of three interlocked cathode plates in accordance with an embodiment of the present disclosure.
Figure 48:
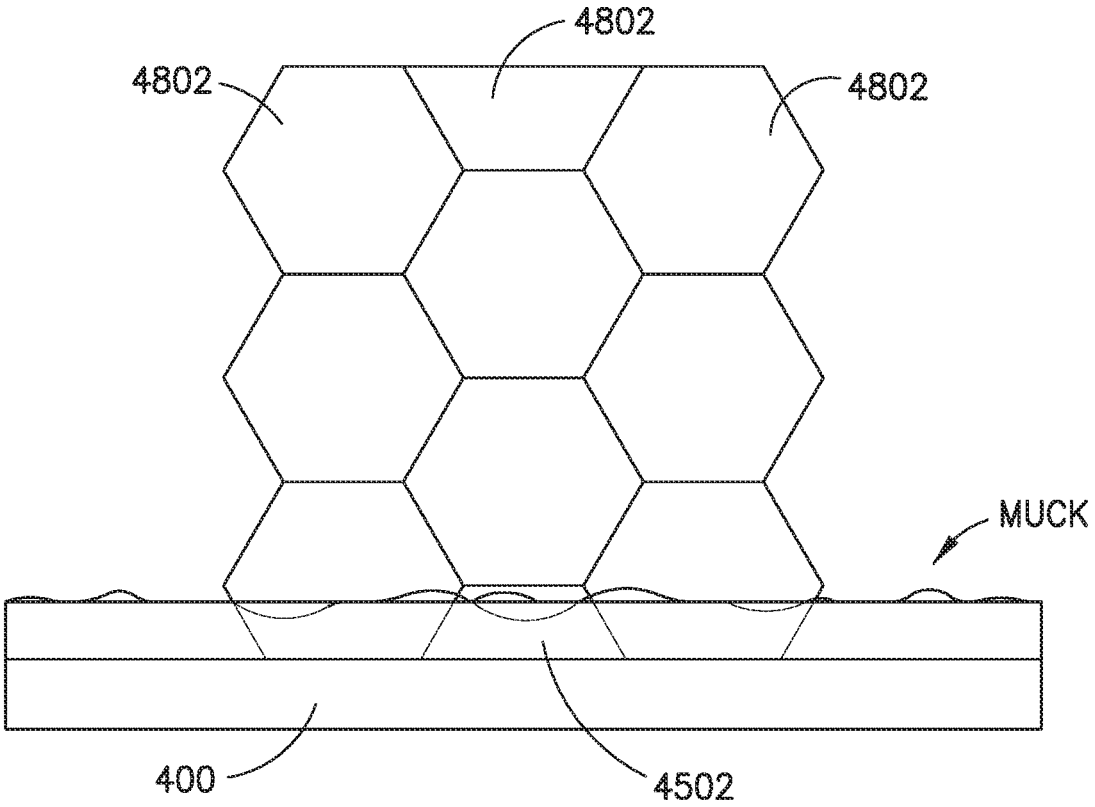
FIG. 48 shows a cathode formed from an array of cathode tiles in accordance with an embodiment of the present disclosure.

In some embodiments, a cathode plate is comprised of multiple cathode plates. FIG. 45 is a front view of three interlocked cathode plates 404. In some embodiments, the cathode plate is comprised of an array of cathode tiles. FIG. 48 and FIG. 49 show a cathode formed from an array of cathode tiles 4802. In some embodiments, at least two of the cathode plates 404 or cathode tiles 4802 mechanically interlock together.

In some embodiments, a cathode plate 404 or cathode tile 4802 has an edge that is configured to mechanically interlock with an adjacent cathode plate or cathode tile. In some embodiments, the edges of adjacent cathode plates 404 or cathode tiles 4802 have beveled edges (e.g. a cut at an inclination that forms an angle other than a right angle) or scalloped edges (e.g. edges having a series of curved projections) that are configured to interlock. Any edge shape that enables the edges of cathode plates or cathode tiles to mechanically interlock may be used. In some embodiments, the edges of the cathode plates 404 or cathode tiles 4802 have holes to accommodate pins that mechanically interlock the cathode plates together.

Figure 46:
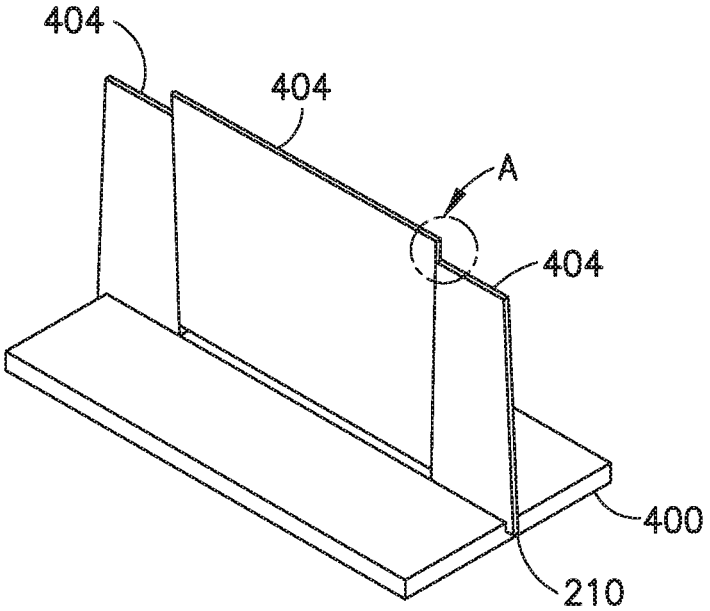
FIG. 46 is a perspective view of the embodiment shown in FIG. 45.
Figure 47:
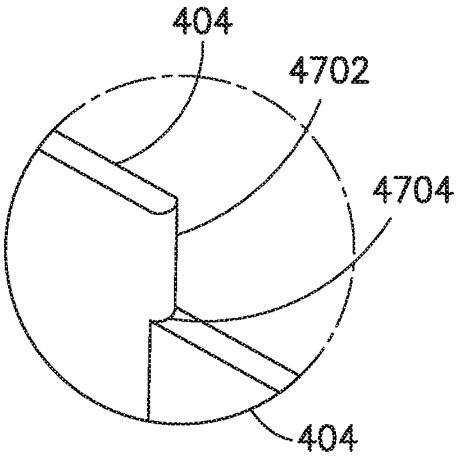
FIG. 47 is an enlarged view of area A of FIG. 46.

FIG. 46 is a perspective view of the embodiment shown in FIG. 45. The middle cathode plate 404 is supported and held above the cathode block 400 by the two adjacent cathode plates 404, which are set in a groove 210 in the cathode block 400. As a result, a flow through path 4502 is formed between the middle cathode plate 404 and the cathode block 400. FIG. 47 is an enlarged view of area A of FIG. 46. FIG. 46 depicts the middle cathode plate 404 having a beveled edge 4702. An adjacent cathode plate 404 has a corresponding mating edge 4704 that is configured to interlock with the beveled edge 4702. In some embodiments, the middle cathode plate 404 is a convex surface which interlocks with a concave edge of the adjacent cathode plate 404.

FIG. 48 shows a cathode formed from an array of cathode tiles 4802. In some embodiments, each tile 4802 is hexagonal shaped. In some embodiments, each cathode tile 4802 is interlocked to adjacent cathode tiles 4802. Two cathode tiles 4802 are set in grooves (not shown) in the cathode block 400. The cathode tiles, such as the center cathode tile 4802, not set in the cathode block 400 and above the muck may be reused as they will not be stuck in the muck when the cell cools. As a result of the center cathode tile 4802 set above the muck, a flow through path 4502 is formed between the middle cathode plate 404 and the cathode block 400.

FIG. 49 shows another embodiment of a cathode formed from an array of cathode tiles 4802. Each cathode tile 4802 is interlocked to adjacent cathode tiles 4802. In some embodiments, a plurality of pins (not shown), as described in various embodiments of the present disclosure, are pinned to the cathode block 400. The cathode tiles 4802 above the muck may be reused as they will not be stuck in the muck when the cell cools.

FIG. 48 shows a cathode formed from an array of cathode tiles 4802. In some embodiments, each tile 4802 is hexagonal shaped. In some embodiments, each cathode tile 4802 is interlocked to adjacent cathode tiles 4802. Two cathode tiles 4802 are set in grooves (not shown) in the cathode block 400. The cathode tiles, such as the center cathode tile 4802, not set in the cathode block 400 and above the muck may be reused as they will not be stuck in the muck when the cell cools. As a result of the center cathode tile 4802 set above the muck, a flow through path 4502 is formed between the middle cathode plate 404 and the cathode block 400.

FIG. 49 shows another embodiment of a cathode formed from an array of cathode tiles 4802. Each cathode tile 4802 is interlocked to adjacent cathode tiles 4802. In some embodiments, a plurality of pins (not shown), as described in various embodiments of the present disclosure, are pinned to the cathode block 400. The cathode tiles 4802 above the muck may be reused as they will not be stuck in the muck when the cell cools.

Figure 50:
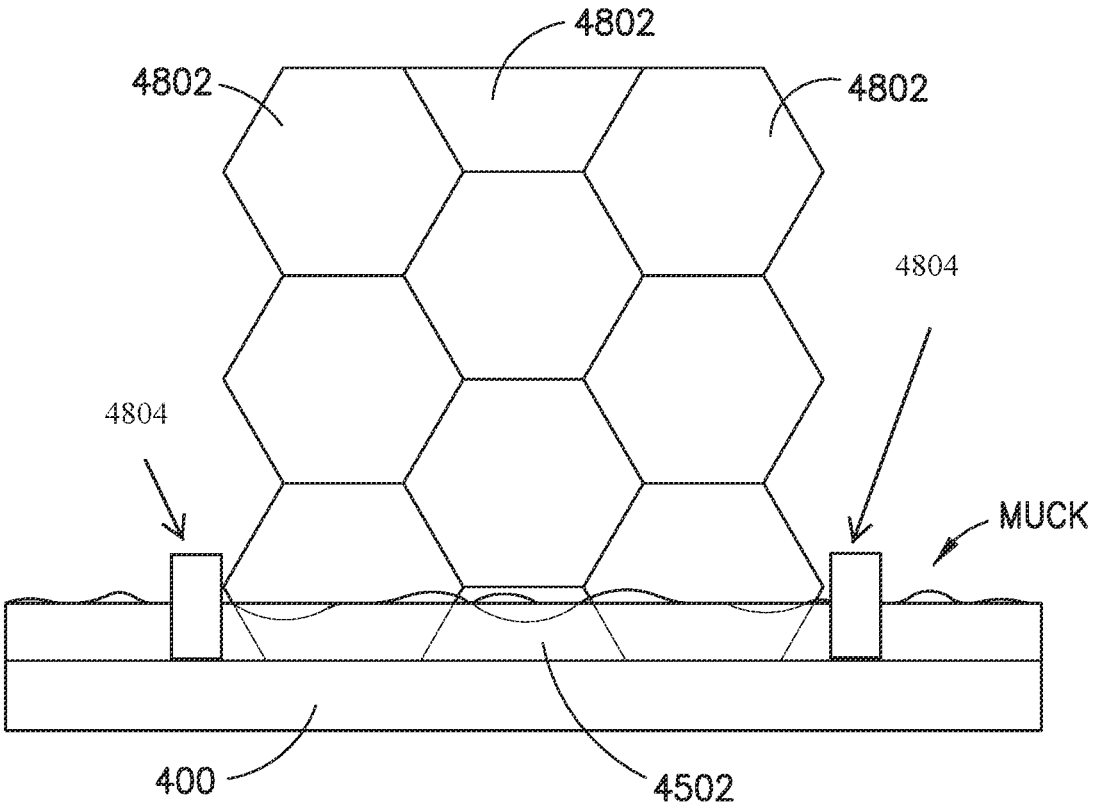
FIG. 50 shows another embodiment of a cathode formed from an array of cathode tiles supported by pins in accordance with an embodiment of the present disclosure.

FIG. 50 shows another embodiment of a cathode formed from an array of cathode tiles 4802. Each cathode tile 4802 is interlocked to adjacent cathode tiles 4802. In some embodiments, a plurality of pins 4804, as described in various embodiments of the present disclosure, are pinned to the cathode block 400 to support the cathode tiles 4802. The cathode tiles 4802 above the muck may be reused as they will not be stuck in the muck when the cell cools.

Figure 51:
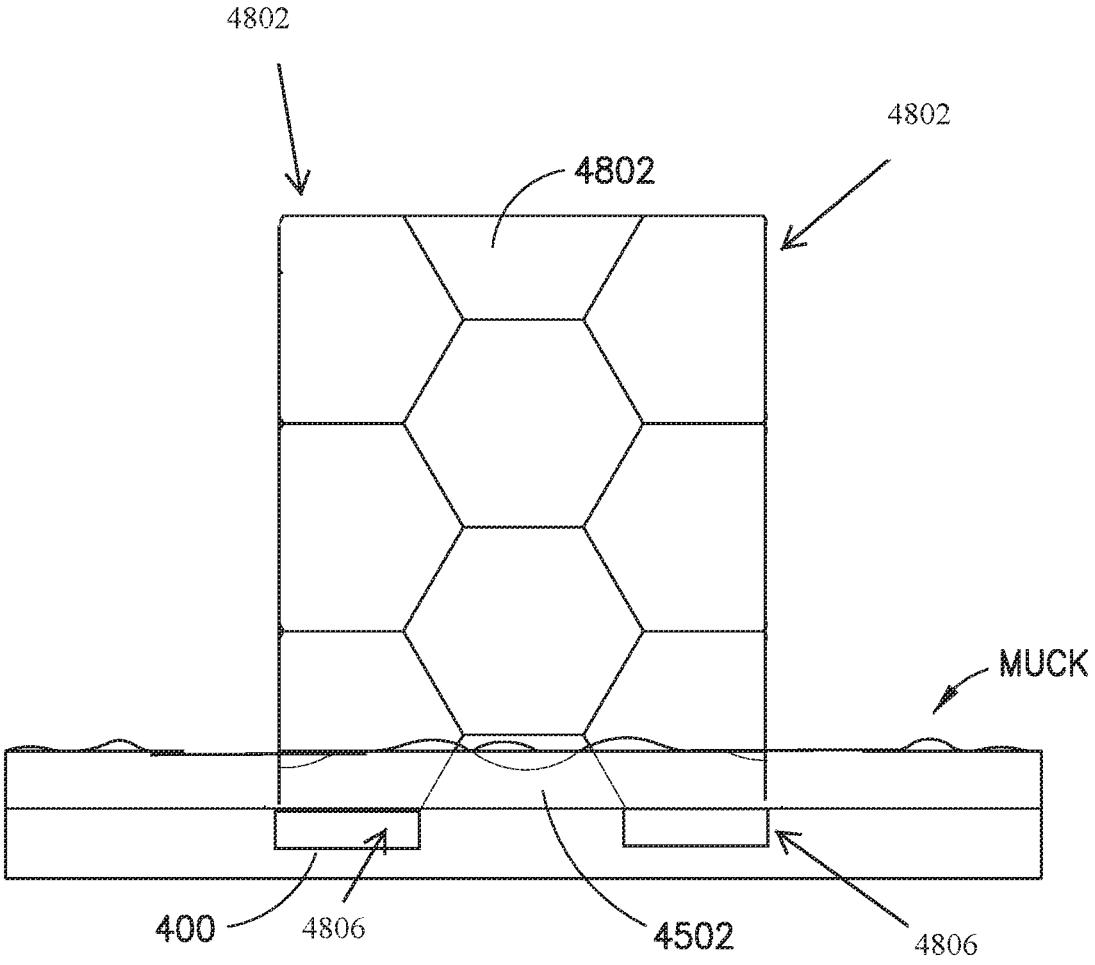
FIG. 51 shows another embodiment of a cathode formed from an array of cathode tiles supported by grooves in accordance with an embodiment of the present disclosure.

FIG. 51 shows a cathode formed from an array of cathode tiles 4802. In some embodiments, each tile 4802 is hexagonal shaped. In some embodiments, each cathode tile 4802 is interlocked to adjacent cathode tiles 4802. Two cathode tiles 4802 are set in grooves 4806 in the cathode block 400. The cathode tiles, such as the center cathode tile 4802, not set in the cathode block 400 and above the muck may be reused as they will not be stuck in the muck when the cell cools. As a result of the center cathode tile 4802 set above the muck, a flow through path 4502 is formed between the middle cathode plate 404 and the cathode block 400.

In some embodiments, draft angles on the interlocking features on the edges of the cathode plates 404 or cathode tiles 4802 allow for some thermal expansion movement of the cathode plates 404 or cathode tiles 4802 without damaging the cathode plates 404 or cathode tiles 4802 during cell startup. In some embodiments, the edge features are formed in the cathode plates 404 or cathode tiles 4802 by green machining, i.e. the machining of ceramic in the unfired state. In some embodiments, the edge features are formed during formed during green processing (e.g. dry pressing, extrusion) of the cathode plates 404 or cathode tiles 4802.

In some embodiments in which the edges of cathode plates or cathode tiles are mechanically interlocked, when a cathode plate or cathode tile, supported on both sides by interlocking cathode plates or cathode tiles, develops a crack, pieces of the cathode do not fall into the bath, but continue to be supported by the interlocking cathode plates or cathode tiles. This extends the useful life of the cathodes and the cell. In some embodiments, even after a crack develops, a broken cathode plate or cathode tile continues to function as a cathode as the electrical connection between the cathode plates or cathode tiles is maintained by physical contact at the edges of the cathode plates or cathode tiles and by the aluminum film on the surface during electrolysis.

In some embodiments, a cathode plate is supported by adjacent cathode plates and not mounted to the cathode block. In this embodiment, a flow through path is formed between the cathode block and the cathode plate.

In some embodiments, a method for producing aluminum metal by the electrochemical reduction of alumina, comprises: (a) passing current between an anode and a cathode through an electrolytic bath of an electrolytic cell, the cell comprising: (i) a cell reservoir, (ii) a cathode support retained on a bottom of the cell reservoir, wherein the cathode support contacts at least one of: a metal pad and a molten electrolyte bath within the cell reservoir, wherein the cathode support includes: a body having a support bottom, which is configured to be in communication with the bottom of the electrolysis cell; and a support top, opposite the support bottom, having a cathode attachment area configured to retain a at least one cathode plates therein; and (b) feeding a feed material into the electrolytic cell. In some embodiments of the above described method, the feed material is electrolytically reduced into a metal product. In some embodiments of the above described method, the metal product is drained from the cathodes to the cell bottom to form a metal pad. In some embodiments of the above described method, a metal product is produced having a purity of P1020.

In some embodiments, the cathode support of the method can be the cathode support in embodiments described in the present disclosure. In some embodiments, the cathode support is configured to provide a metal and/or bath flow through path. In some embodiments, the cathode support includes at least one (or a plurality of) cut-outs or machined portions along the bottom region of the cathode support. In some embodiments, the cut-outs are along the bottom of the cathode support (i.e. extending from the bottom surface of the cathode support up to a surface along the side(s) of the support). In some embodiments, the cut-outs are located along the sides (e.g. extending from one side through the body of the cathode support to the other side of the cathode support (removed from the bottom surface of the cathode support). In various embodiments, the cut-outs are configured to allow bath and/or metal to flow through the cathode support, and are of any shape or dimension for this purpose.

In some embodiments, the cathode attachment area of the cathode support comprises: a plurality of raised ridges (e.g. like a rack), where the plurality of ridges are spaced and configured to permit cathode plates to slide in between ridges and be retained by the ridges. In some embodiments, the cathode support has a plurality of raised/extended portions (e.g. each with a top and opposing sides) along its upper surface, where the raised/extended portions are configured in a spaced relation to support a cathode plate between two sides (e.g. opposing sides) of two raised/extended portions. In some embodiments, the cathode attachment area of the cathode support comprises a raised surface topography to retain cathode plates therein.

In some embodiments, the cathode support comprises: carbonaceous material (e.g. graphite); $TiB_2$-carbon composite material, titanium diboride ($TiB_2$), silicon carbide (SiC), boron nitride (BN), Silicon nitride ($Si_3N_4$), hafnium boride ($HfB_2$), $HfB_2$-carbon composite materials, zirconium diboride ($ZrB_2$), $ZrB_2$-carbon composite materials, metals, alloys, and combinations thereof. In some embodiments, the cathode support comprises a composite material (e.g. graphite coated in a ceramic material, like $TiB_2$). In some embodiments; the cathode support is made from aluminum wettable materials. In some embodiments, the cathode plates are made from aluminum wettable materials. In some embodiments, aluminum wettable materials are materials having a contact angle with molten aluminum of not greater than 90 degrees in the molten electrolyte. Some non-limiting examples of wettable materials may comprise one or more of $TiB_2$, $ZrB_2$, $HfB_2$, $SrB_2$, carbonaceous materials, and combinations thereof.

In some embodiments, the cathode support is configured to attach to the cell bottom. Some non-limiting examples of fasteners (attachment devices) include: mechanical fastener(s), bolts, screws, fasteners, brackets, ram-in-place, and combinations thereof.

In some embodiments, cathode plate supports support the cathode plates and hold the cathode plates in a vertical position. In some embodiments, the cathode plate supports comprise plates set within grooves cut into the cathode block. In some embodiments the cathode plate supports are comprised of titanium diboride. In some embodiments, the cathode plate supports are comprised of the same material as at least one cathode plate.

What is claimed is:

1. A method for producing aluminum, comprising:

(a) passing current between an anode and a cathode through an electrolytic bath of an electrolytic cell, the electrolytic cell comprising:

(i) a plurality of vertical anode plates, (ii) a plurality of vertical cathode plates, (iii) a cathode support located on and coupled to a carbon cathode block, wherein the cathode support is in contact with at least one plate of the plurality of vertical cathode plates, (A) wherein the cathode support is a separate component from the carbon cathode block, (B) wherein the cathode support comprises at least one cathode attachment configured to retain the at least one plate of the plurality of vertical cathode plates, (C) wherein the at least one cathode attachment comprises at least one of:

(1) surface grooves on an upper surface of the cathode support, wherein the surface grooves are configured to directly contact and support the at least one plate of the plurality of vertical cathode plates, (2) raised extended portions, wherein the raised extended portions are configured to support the at least one plate of the plurality of vertical cathode plates; and (b) feeding a feed material into the electrolytic cell.

2. The method of claim 1, further comprising (c) electrolytically reducing the feeding material into a metal product.

3. The method of claim 2, further comprising: (d) draining the metal product from the plurality of vertical cathode plates to a bottom of the electrolytic cell to form a metal pad.

4. The method of claim 2, wherein the metal product has a purity of P1020.

5. The method of claim 1, wherein the electrolytic bath comprises at least one of NaF, $AlF_3$, CaF2, MgF2, LiF, and KF.

6. The method of claim 1, wherein the cathode support comprises at least one of titanium diboride-carbon composite material, titanium diboride, silicon carbide, boron nitride, silicon nitride, hafnium boride, hafnium boride-carbon composite material, zirconium diboride, zirconium diboride-carbon composite material, and carbonaceous materials.

7. The method of claim 1, wherein the at least one plate of the plurality of vertical cathode plates is constructed of a transition metal boride compound.

8. The method of claim 7, wherein the transition metal boride compound is titanium diboride.

9. The method of claim 1, wherein the surface grooves comprise a sufficient depth to retain the plurality of vertical cathode plates.

10. The method of claim 1, wherein the plurality of vertical cathode plates comprises at least one of a first cathode plate and a second cathode plate, wherein an edge of the first cathode plate touches an edge of the second cathode plate.

11. The method of claim 1, wherein the at least one cathode attachment further comprises a plurality of pins.

12. The method of claim 11, wherein the plurality of pins includes a first set of pins and a second set of pins.

13. The method of claim 11, wherein pin bottoms of the plurality of pins are retained by corresponding openings in the cathode support.

14. The method of claim 13, wherein the plurality of pins are positioned in a spaced relation from one another and wherein at least some of the plurality of pins support the at least one plate of the plurality of vertical cathode plates in a vertical configuration.

15. The method of claim 1, wherein the carbon cathode block is fixedly coupled to a bottom of the electrolytic cell.

16. The method of claim 1, wherein both the plurality of vertical anode plates and the plurality of vertical cathode plates are configured in an alternating parallel configuration.

17. The method of claim 1, wherein the electrolytic cell further comprises an anode assembly for retaining at least one plate of the plurality of vertical anode plates.

18. The method of claim 1, wherein the cathode support comprises carbonaceous materials.

19. The method of claim 1, wherein the at least one plate of the plurality of vertical cathode plates is comprised of multiple cathode plates.

20. The method of claim 1, wherein the raised extended portions define a rack.

* * * * *